US011986745B2

(12) United States Patent
Licht et al.

(10) Patent No.: US 11,986,745 B2
(45) Date of Patent: May 21, 2024

(54) TOY TOP LAUNCHER

(71) Applicant: LEGO A/S, Billund (DK)

(72) Inventors: Peter de Fine Licht, Billund (DK); Ruben Romijnders, Billund (DK); Henrik Larsen, Billund (DK)

(73) Assignee: LEGO A/S, Billund (DK)

( * ) Notice: Subject to any disclaimer, the term of this patent is extended or adjusted under 35 U.S.C. 154(b) by 76 days.

(21) Appl. No.: 17/425,658

(22) PCT Filed: Jan. 29, 2020

(86) PCT No.: PCT/EP2020/052190

§ 371 (c)(1),
(2) Date: Jul. 23, 2021

(87) PCT Pub. No.: WO2020/157148

PCT Pub. Date: Aug. 6, 2020

(65) Prior Publication Data

US 2022/0088497 A1 Mar. 24, 2022

(30) Foreign Application Priority Data

Jan. 29, 2019 (DK) ..... PA201970055

(51) Int. Cl.
*A63H 1/02* (2006.01)

(52) U.S. Cl.
CPC ..... *A63H 1/02* (2013.01)

(58) Field of Classification Search
CPC ..... A63H 1/02; A63H 13/10; A63H 17/006
See application file for complete search history.

(56) References Cited

U.S. PATENT DOCUMENTS 1,700,381 A * 1/1929 Schmidt ..... A63H 1/02 446/241
3,018,584 A * 1/1962 Passariello ..... A63H 1/02 446/259

(Continued)

FOREIGN PATENT DOCUMENTS

CN 102179050 A 9/2011
CN 204563582 U 8/2015

(Continued)

OTHER PUBLICATIONS

Translation KR950004609Y1 (Year: 1995).*

(Continued)

*Primary Examiner* — Eugene L Kim
*Assistant Examiner* — Alyssa M Hylinski
(74) *Attorney, Agent, or Firm* — Day Pitney LLP; George N. Chaclas; Anthony A. Kassas

(57) ABSTRACT

A toy top launcher for launching a toy top including a launcher adapter, the toy top launcher having a housing;

a barrel formed in the housing and configured for receiving the launcher adapter; and a lever arm pivotally connected to the housing, wherein the lever arm has a first end and a second end opposite to the first end, wherein the first end of the lever arm extends into the barrel, wherein the second end of the lever arm extends out of the housing, and wherein the barrel comprises a first screw thread configured for cooperating with a mating screw thread on the launcher adapter.

14 Claims, 13 Drawing Sheets

(56) References Cited

U.S. PATENT DOCUMENTS

| | | | | | |
|---|---|---|---|---|---|
| 3,032,921 | A * | 5/1962 | Greene | A63H 3/48 | 446/190 |
| 3,328,909 | A * | 7/1967 | Blanton, Jr. | A63H 1/02 | 446/241 |
| 4,795,396 | A * | 1/1989 | Lindstrom | A63H 1/02 | 446/259 |
| 4,932,918 | A * | 6/1990 | Onoda | A63H 1/02 | 446/256 |
| 5,518,437 | A * | 5/1996 | Nonaka | A63H 1/02 | 446/259 |
| 5,545,068 | A * | 8/1996 | Asbaghi | A63H 27/14 | 446/260 |
| 5,827,107 | A * | 10/1998 | Bears | A63H 1/20 | 446/259 |
| 6,769,953 | B1 * | 8/2004 | Sutton | A63H 1/02 | 446/256 |
| 8,967,130 | B2 * | 3/2015 | Victor | F41B 7/08 | 124/16 |
| 9,844,734 | B2 * | 12/2017 | Garling | A63H 13/10 | |
| 2010/0282227 | A1 * | 11/2010 | Vanek | F41B 7/08 | 124/31 |
| 2014/0090630 | A1 * | 4/2014 | Bird | A63H 33/009 | 124/31 |

FOREIGN PATENT DOCUMENTS

| | | | |
|---|---|---|---|
| CN | 206535193 | U | 10/2017 |
| CN | 208193645 | U | 12/2018 |
| CN | 208319968 | U | 1/2019 |
| ES | 1027325 | U | 8/1994 |
| JP | 2015130932 | A | 7/2015 |
| KR | 950004609 | Y1 * | 6/1995 |
| WO | 2016/026304 | A1 | 2/2016 |

OTHER PUBLICATIONS

First Office Action issued in corresponding Chinese Patent Application No. 202080011254.7, dated Apr. 29, 2022, 6 pages (English translation only).

First Technical Examination and Search Report issued in corresponding Danish patent application No. PA201970055, dated Sep. 3, 2019, 7 pages.

International Search Report and Written Opinion issued in corresponding international patent application No. PCT/EP2020/052190, dated Jun. 4, 202, 10 pages.

* cited by examiner

TOY TOP LAUNCHER

CROSS-REFERENCE TO RELATED APPLICATIONS

This application is a U.S. National Stage of International Application No. PCT/EP2020/052190, filed on 29 Jan. 2020 and published on 6 Aug. 2020, as WO2020/157148, which claims the benefit of priority to Danish Patent Application No. PA 2019 70055, filed on 29 Jan. 2019. The content of each of the above referenced patent applications is incorporated herein by reference in its entirety for any purpose whatsoever.

The present invention relates to a toy top launcher for launching a toy top and toy system comprising a toy top launcher and a toy top, a toy top launcher adapter, and a method of launching a toy top.

DESCRIPTION OF RELATED ART OR BACKGROUND OF THE INVENTION

Toy tops are devices often formed as rotation symmetrical objects which may be brought to spin/rotate on a surface, such as a table or a floor. Toy tops are sometimes referred to as toy spinners, or spinner tops. However, in the context of the present invention they will be referred to as toy tops.

A toy top may be brought to spin simply by a user spinning the toy top between e.g. an index finger and the thumb in a counteracting motion. Toy tops may be used, especially as toys for children. Toy tops may be used to battle, where to users simultaneously or consecutively launches their toy tops on a surface, where after the toy tops may spin around and/or bounce on the surface, and bump into each other.

Such collisions may cause a toy top to be knocked of a predefined portion of the surface or be caused to tilt and stop spinning. Thereby, a set of toy tops may be used to battle, where for example the user having the toy top spinning for the longest time, or staying within a predefined portion of a surface may win.

In order to increase the spinning momentum of a toy top a number of different toy tops launchers are known in the art. On example is shown in the US patent, U.S. Pat. No. 4,932,918. The patent discloses a mechanism with a rotatable shaft driven by a coil spring to rotate a socket in which a toy top may be placed. When sufficient rotation of the toy top is reached, the rotation of the socket is stopped, and a set of cooperating helical threads on the toy top and in the socket, will cause the toy top to be expelled from the socket. The spring coil construction makes the toy top launching mechanism complex and large. Coil springs have a tendency to over stretch. Further, in order to launch the toy top the coil spring of mechanism must be continuously rewound. In order to provide sufficient power to the toy top, thecoil spring must be quite long. Therefore, the rewinding of the coil spring may take very long, which is a disadvantage, for example in a battle situation, where a user may want to launch a series of toy tops quickly after each other. Further the long rotatable shaft supporting the coil spring and numerous interacting parts makes the mechanism fragile to rough handling, and thus prone to break more easily in the hands of an exited child.

There is therefore a need for a robust device for launching toy tops, which is also simple in structure and may be more compact than in the prior art. It is therefore an object of the invention to provide a robust device for launching toy tops, which is also simple in structure and may be more compact than in the prior art. It is also an object of the invention to increase the variety of options.

SUMMARY OF THE INVENTION

In a first aspect of the invention, the above mentioned and other objects of the invention are achieved by toy top launcher for launching a toy top comprising at least a launcher adapter, the toy top launcher comprising

- a housing;
- a barrel formed in the housing and configured for receiving the launcher adapter;
- a lever arm pivotally connected to the housing and rotatable relative to the barrel, wherein the lever arm has a first end and a second end opposite to the first end, wherein the first end of the lever arm extends into the barrel; wherein the second end of the lever arm extends out of the housing, and wherein the barrel comprises a first screw thread configured for cooperating with a mating screw thread on the launcher adapter.

Thus, when a launcher adapter is placed in the barrel, and the second end of the lever arm is pushed, the lever arm is rotated, causing the launcher adapter to be pushed along a longitudinal axis of the barrels, and being rotated by the mating screw threads on the launcher adapter and in the barrel.

Thereby a very simple, easy to manufacture, robust toy top launcher is achieved.

In an embodiment, the housing of the toy top launcher has a flat lower surface defining a plane, and the barrel has a longitudinal axis, which forms an acute first angle with said plane. Thereby, when a toy top is launched from the toy top launcher placed on a surface (such as a table or a floor) the toy top will follow a trajectory extending both in the vertical and horizontal direction.

Preferably, the first angle is 50-80°, more preferably 60-70°, such as 65°.

Objects of the invention may further be obtained—in a second aspect of the invention by a toy system comprising a toy top and a toy top launcher, wherein the toy top comprises at least a launcher adapter, wherein the toy top launcher comprises

- a housing;
- a barrel formed in the housing and configured for receiving the launcher adapter; and
- a lever arm pivotally connected to the housing, wherein the lever arm has a first end and a second end opposite to the first end, wherein the first end of the lever arm extends into the barrel, wherein the second end of the lever arm extends out of the housing, and wherein the barrel comprises a first screw thread, and the launcher adapter comprises a second screw thread, which is configured for cooperating with the first screw thread in the barrel.

In an embodiment the first screw thread is formed as one or more elongate helical beads radially extending from a wall of the barrel, and where the second screw thread is formed as a matching number of helical grooves formed in an outer surface of the launcher adapter. Alternatively, the first screw thread may be formed as one or more elongate helical grooves formed in a side wall of the barrel, and where the second screw thread is formed as a matching number of helical beads radially extending from an outer wall of the launcher adapter.

In a further embodiment thereof, the elongate helical beads radially extending from a wall of the barrel or from the outer wall of the launcher adapter are punctuated into bead sections.

Alternatively, the first screw thread is formed as one or more notches in a launch flange surrounding an opening of said barrel, and wherein the second screw thread is formed as a matching number of helical elongate beads formed on and extending from an outer surface of the launcher adapter.

It will be appreciated that features of the described embodiments of the toy top launcher of the toy system of the second aspect of the invention may be applied in the above mentioned toy top launcher according to the first aspect of the invention as well. Also, it will be appreciated that the features of the embodiments of the toy top launcher according to the first aspect of the invention may form embodiments of the toy system according to the second aspect of the invention as well.

Objects of the invention may further be obtained—in a third aspect of the invention—by a launcher adapter for a toy top, the launcher adapter comprising an adapter body having a first end surface and a second end surface, and a cylindrical outer surface and a screw thread arranged at the outer surface, wherein the first end surface is provided with attachment means of a first type being configured for cooperating with attachment means of a second type. Thereby, the launcher adapter 20 may be connected to a main body portion of a toy top, where the main body portion of the toy top has attachment means of the second type. Further, this will allow the launch of a toy top comprising at least the launcher adapter, from a toy top launcher according to the first aspect of the invention, or for use in a toy system according to any of the embodiments of the toy system according to the second aspect of the invention.

In an embodiment, the second end surface of the launcher adapter is provided with a rounding or rounded shape.

Objects of the invention may further—in a fourth aspect of the invention—be obtained by a method of launching a toy top, the method comprising

- providing a barrel having a first screw thread;
- providing a lever arm having a first end and a second end, where the lever arm is pivotal relative to barrel and the first end of the lever arm extends into the barrel,
- providing a toy top comprising at least a launcher adapter provided with a second screw thread being configured for mating with the first screw thread of the barrel
- placing the launcher adapter in the barrel, such that a lower, second end surface of the launcher adapter is in contact with the first end of the lever arm;
- providing a push to the second end of the lever arm inducing a rotation of the lever arm forcing the launcher adapter to move along a longitudinal axis of the barrel, whereby the mating screw threads on the launcher adapter and the barrel (50) induces a rotation of the launcher adapter.

Thereby, a launch of the toy top comprising at least a launcher adapter provided, where the launcher adapter is both rotated and induced with a linear motion.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

In the following the toy top launcher 30 according to one aspect and the toy system 1 according to another aspect of the invention will be described in greater detail.

The toy system 1 according to an aspect of the invention comprises a toy top launcher 30 and toy top 10. The toy top 10 comprises at least a launcher adapter 20.

Figure 1:
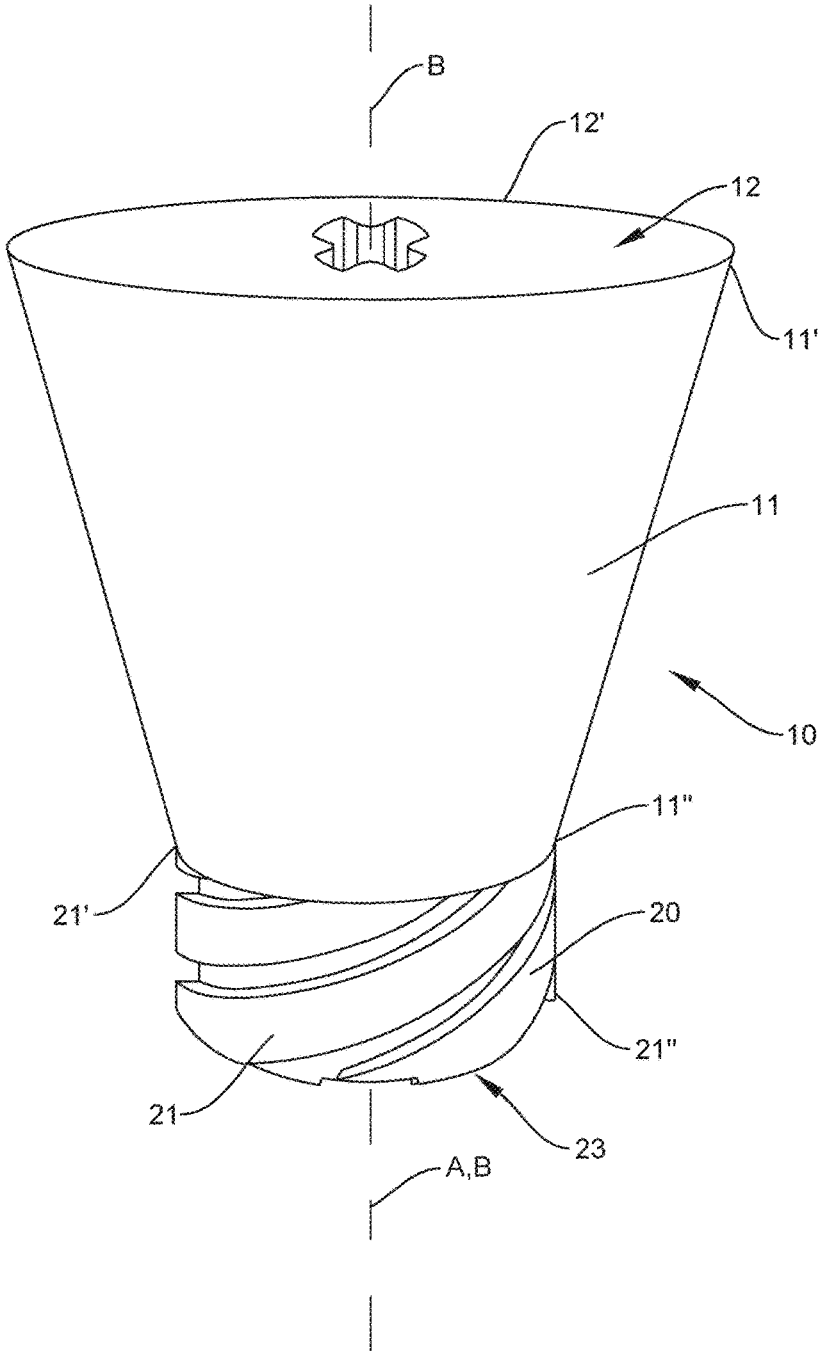
FIG. 1, in a perspective view, shows a toy top with a launcher adapter.

FIG. 1 sketches a toy top 10 according to one embodiment. The toy top 10 shown in FIG. 1 comprises launcher adapter 20, which is generally rotationally symmetrically formed. The launcher adapter 20 comprises a first end 21' and a second end 21", and a first longitudinal axis, A. The toy top 10 further comprises a main body portion 11, which is generally rotation symmetrically formed. The main body portion 11 of the toy top comprises a first end 11' and a second end 11", and a second longitudinal axis, B. The main body portion 11 of the toy top 10, in the embodiment shown in FIG. 1, further comprises a first (or upper) end surface 12 provided at the first end 11'. The main body portion 11 may be conical as shown in FIG. 1. However, in other embodiments the main body portion may take other forms. For example, the main body portion may be formed as a circular plate or a disc. In yet other embodiments, the main body portion 11 may be shaped as a hollow conical structure, i.e. such that a first end surface 12 of the main body portion 11, would be represented by just a rim 12' as indicated in FIG. 1.

Figure 3:
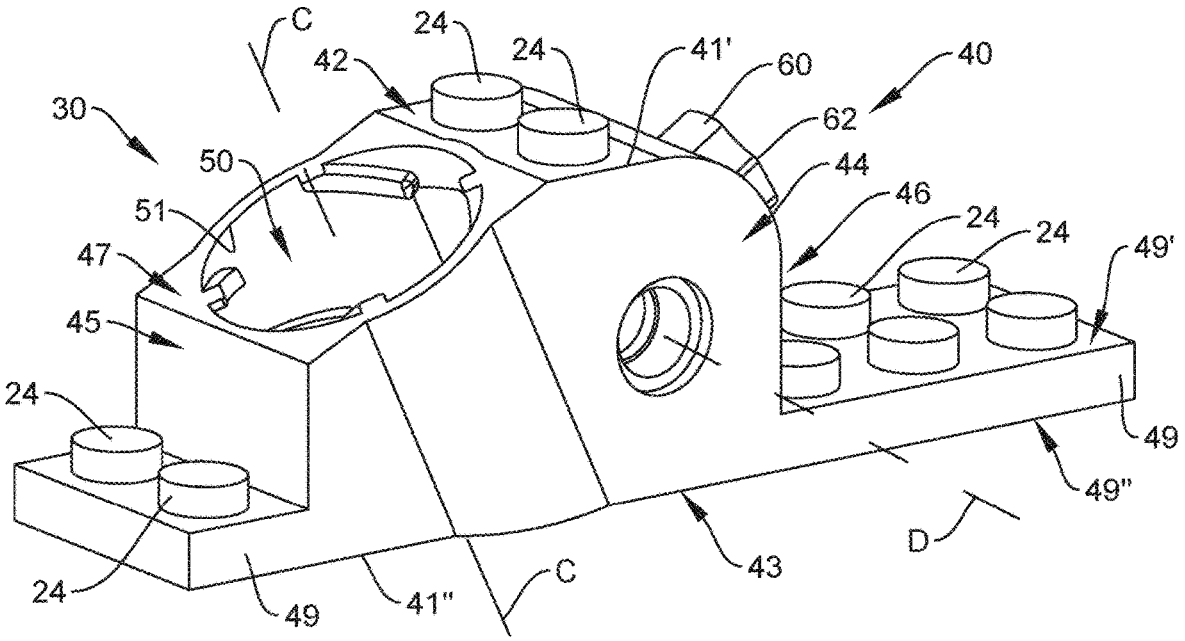
FIG. 3, in a perspective view, shows a toy top launcher according to an embodiment.

The launcher adapter 20 is arranged at the second end 11" of the main body portion 11 of the toy top 10. The launcher adapter 20 is configured for cooperating with a toy top launcher 30. The toy top launcher 30, see e.g. FIG. 3, is configured for launching the toy top 10, as will be described in further detail below.

In some embodiments, the launcher adapter 20 and the main body portion 11 may be formed as one integrated unit to form a toy top 10. However, as shown in e.g. FIGS. 2, 5, 10A and 13, the launcher adapter 20 may in embodiments form an individual part being releasably connectable to a main body portion 11 of the toy top 10. The launcher adapter may further be construed as constituting a toy top 10 in itself.

Figure 2:
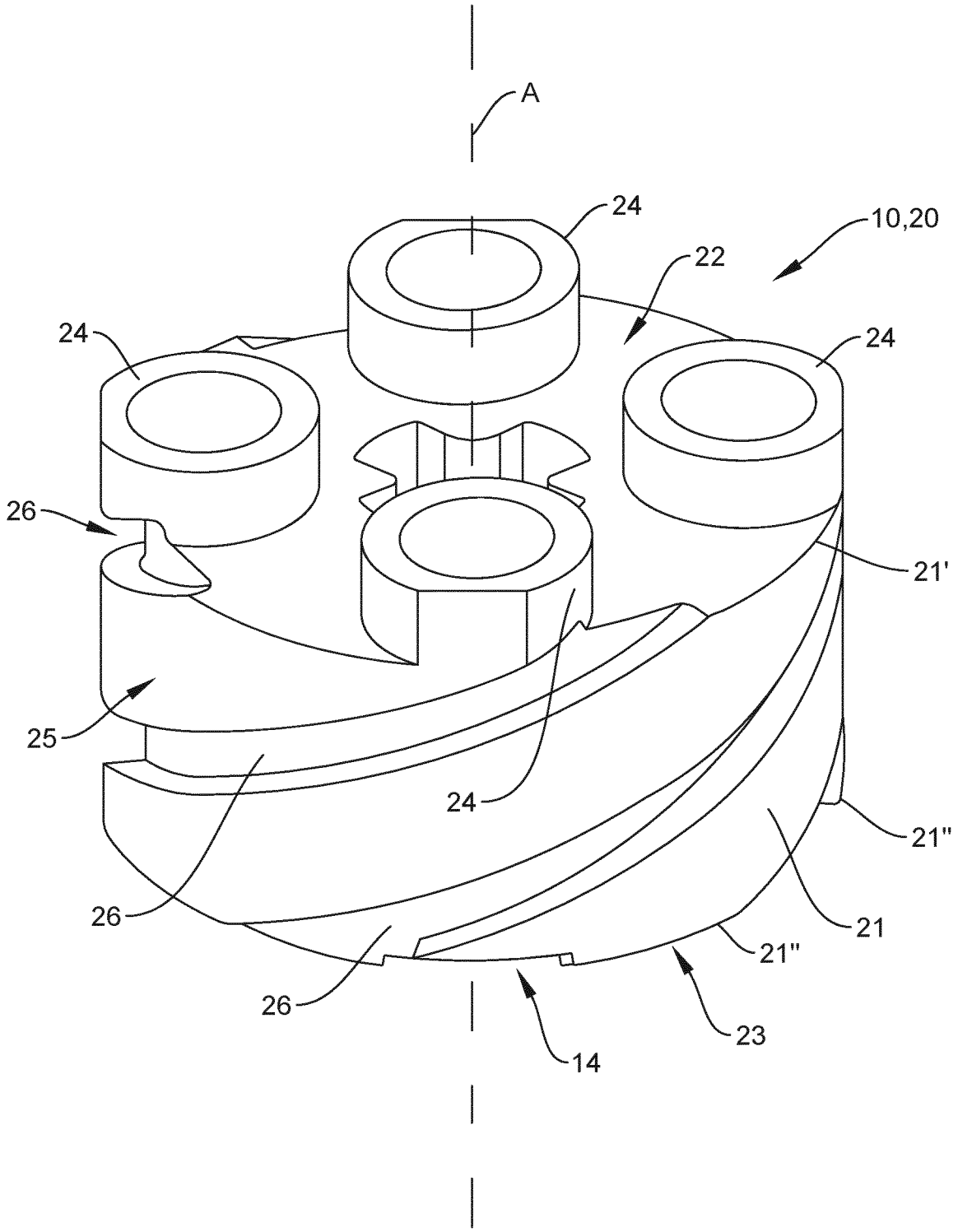
FIG. 2, in a perspective view, shows a launcher adapter according to one embodiment.

Now referring to FIG. 2, the launcher adapter 20 comprises an adapter body 21, which may have a cylindrical shape and a first longitudinal axis, A, as also mentioned above. The first longitudinal axis, A, is coaxial with the second longitudinal axis, B, of the main body portion 11, when the launcher adapter 20 is connected to the main body portion 11 of the toy top 10, or when the launcher adapter 20 is an integral part of the toy top 10.

The adapter body 21 of the launcher adapter 20 has a first end 21' and a second end 21", a side surface 25 extending between the first end 21' and the second end 21", and a second end surface 23 formed at the second end 21" thereof. In embodiments, where the launcher adapter 20 is integrally formed with the main body portion 11, the second end 11" of the main body portion 11 and the first end 21' of the adapter body 21 coincide.

In embodiments, where the launcher adapter 20 is releasably connectable to the main body portion 11 of the toy top 10, the launcher adapter 20 comprises a first end surface 22, formed at the first end 21' of the adapter body 21. The first end surface 22 of the adapter body 21 may comprise attachment means of a first type 24.

In embodiments, where the launcher adapter 20 is releasably connectable to the main body portion 11 of the toy top 10, the main body portion 11 comprises a second end surface (not shown) provided at the second end 11" of the main body portion 11. In this case the second end surface of the main body portion 11, comprises attachment means of a second type 14 which are configured for cooperating with the attachment means of a the first type 24 on the first end surface 22 of the adapter body.

So, the attachment means of the first type 24 are complementary to the attachment means of the second type 14, in such a way that e.g. one main body part 11 may releasably be attached to an adapter body 20, by a friction fit, such as is known in the art of toy building blocks.

The first type of attachment means 24 are preferably formed on, and extending from, the first end surface 22 of the adapter body 21.

The second type of attachment means 14 are preferably formed in the second end surface 13 of the main body portion 11.

Figure 7A:
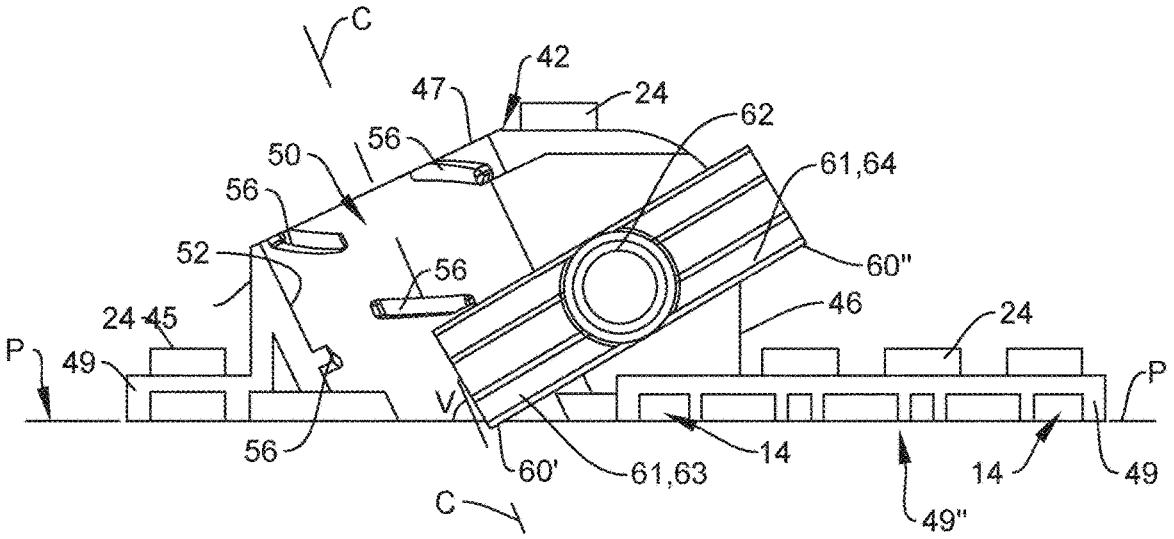
FIG. 7A, in a sectional side view, shows the toy top launcher shown in FIG. 3.

In embodiments, and as indicated in e.g. the FIGS. 2 and 7A, the second end surface 23 of the adapter body 20 may comprise attachment means of the second type 14.

As shown in FIG. 2, the first type of attachment means 24 are preferably knobs or studs, i.e. cylindrical protrusions on the first end surface 22. The first type of attachment means 24 on the first end surface 22 of the adapter body 21 are formed in a regular two dimensional grid of $n_1 \times n_2$ lattice positions with knobs/studs/protrusions, i.e. the first attachment means 24 on the first end surface 22 are arranged in perpendicular rows and columns.

The second type of attachment means 14 are preferably one or more indentations shaped and sized and spaced apart to cooperate with the knobs. The second type of attachment means 14 is not shown in the view provided in FIG. 2. However, the second type of attachment means 14 on the second end surface 23 of the adapter body 20 are of the same type as the second type of attachment means 14 shown in e.g. FIGS. 4, 6A-B and 7A-C.

FIG. 2 shows a launcher adapter 20, where the first end surface 22 is provided with 2×2 lattice positions of knobs/studs/protrusions.

It will be appreciated that (in not shown embodiments) the complementary first and second type of attachment means 24, 14 (e.g. knobs and indentations) may be reversed between the parts 11, 20.

The launcher adapter 20 may be formed in a material such as plastic. The launcher adapter 20 may be formed in an injection molding process.

The main body portion 11 of the toy top 10 may be formed in a material such as plastic. The main body portion 11 of the toy top 10 may be formed in an injection molding process.

In embodiments the main body portion 11 of the toy top 10 and the launcher adapter 20 may be formed integrally as a single unit, and in a material such as plastic. The main body portion 11 of the toy top 10 and the launcher adapter 20 may be formed integrally in an injection molding process.

FIG. 3 shows a toy top launcher 30 according to an embodiment of the invention. The toy top launcher 30 according to the embodiments described below, is configured for receiving and ejecting (launching) a toy top 10 as described above. Preferably, a launch of a toy top involves at shooting the toy top upwards and away from the toy top launcher (in a direction parallel to horizontal), while simultaneously spinning/rotating the toy top around it's longitudinal direction/axis A, B.

The toy top launcher 30 comprises a housing 40, a barrel/launcher port 50 formed in the housing 40, and a lever arm 60 pivotally connectable to the housing 40.

The housing 40 comprises a main body part 41 having an upper surface 42 and a flat lower surface 43, and a set of side walls 44 connecting the upper surface 42 and the flat lower surface 43. The flat lower surface 43 is configured for cooperating with another flat surface (not shown) such as a table or a floor, or another toy, such as e.g. a toy building block or a toy construction made of toy building blocks. The flat lower surface 43 thereby allows for a stable connection to another flat surface.

The flat lower surface 43 of the main body part 41 of the housing 40 of the toy top launcher 30 defines a plane, P, see FIG. 7A, showing a sectional side view through the toy top launcher 30 of FIG. 3.

The flat lower surface 43 of the toy top launcher 30 may be provided with attachment means, such as the second type of attachment means 14 described above, and as shown in e.g. FIG. 4-11. FIGS. 12-15 shows embodiments, where no attachment means of the second type 14 are provided at the lower surface 43. The flat lower surface 43 of the toy top launcher 30 being provided with attachment means of the second type 14 allows the toy top launcher 30 to be coupled to e.g. building blocks having at least attachment means of the first type 24.

The main body part 41 of the housing 40 is preferably partially hollow. The main body part 41, in the embodiment shown, comprises two parallelly arranged side walls 44, a front 45, and a back surface 46. The side walls 44, the front wall 45 and the back surface 46 may, as shown, extend vertically. The main body part 41 may further comprise an upper or top wall 42. The upper wall 42 may, as shown, extend horizontally. The two parallelly arranged side walls 44 extends between an upper rim 41' and lower rim 41" The upper wall 42 preferably connects the two parallelly arranged side walls 44 at the upper rims 41', thereof. The main body part 41 may have an open bottom surface 43, forming an opening into the hollow of the main body part 41. The back surface 46 is preferably also open to allow portions of the lever arm 60 to extend there through, as described in further detail below. The main body part 41 preferably further comprises a slanted surface 47.

As shown the slanted surface 47 extends between the front surface 45 and the upper surface 42. However it will be appreciated that in other, not shown embodiments, the slanted surface may extend from the upper wall 42 to the lower rim 41" of the main body part 41.

The upper wall 42 may, as shown in e.g. FIG. 3 be provided with attachment means of the first type 24.

The main body part 41 of the housing 40 may be formed in material such as plastic. The main body part 41 of the housing 40 may be formed in an injection molding process.

The housing 40 of the toy top launcher 30 may further comprise a plate 49. The plate 49 and the main body part 41 of the housing 40 may preferably, and as shown in e.g. FIGS. 4 and 5, be integrally formed in a material such as a plastic. The housing 40 may also in such embodiments be formed in an injection molding process.

The plate 49 comprises a flat lower surface 49' defining a plane. The plate 49 is preferably formed at a lower side of the main body part 41 of the housing 40 of the toy top launcher 30. The flat lower surface 43 of the main body part 41 of the housing 30 may form part of a lower surface 49" of the plate 49, such that the plane, P, defined by the flat lower surface 43 of the main body part 41, and the plane defined by the lower flat surface 49" of the plate 49 coincide.

Attachment means of the second type 14 may be formed in the entire lower surface 43, 49" of the plate 49. Thereby, the plate 49 of the toy top launcher 30 may be releasably connected to toy building block or a toy construction set of toy building blocks with at least attachment means of the first type 24.

The plate 49 also comprises an upper surface 49'. The main body part 41 preferably extends upward from the upper surface 49' of the plate 49. The upper surface 49' of the plate 49 may in embodiments, and as shown, be provided with attachment means. Preferably, the attachment means on the upper surface 49' of the plate 49 are of the first type of attachment means 24, described above.

Thereby, the toy top launcher 30 may be configured for cooperating with for example toy building blocks having at least attachment means of the second type 14.

In not shown embodiments, the plate 49 and the main body part 41 of the housing 40 may constitute individually formed parts, being releasably connectable to the each other. In this case, an entire upper face 49' of the plate 49 may be provided with attachment means of the first type 24, and the lower flat surface 43 of the housing 40 may be provided with attachment means of the second type 14, whereby the housing 40 may be connected on the plate 44. It will be appreciated, that in this case the plane, P, defined by the flat lower surface 43 of the housing 40 is parallel to the flat lower surface 44" of the plate 44, but not coinciding therewith.

The above mentioned barrel 50 comprises a cylindrical hole or opening 51 in the main body 41 of the housing 40, and an inner side wall 52, and is configured for receiving a launcher adapter 20. The barrel 53 forms an elongate hole 53 in the housing 40 of the toy top launcher 30, the barrel 50 having a longitudinal axis C, The inner side wall 52 preferably has a circular cross section, .i.e. the barrel 50 forms a generally cylindrical hole inside the housing 40 of the toy top launcher 30. A diameter of the barrel 50 may preferably be equal to, or slightly larger, than a diameter of adapter body 21 of the launcher adapter 20.

The opening 51 into the barrel 50 preferably, and as shown is provided through the slanted surface 47 described of the main body part 41 of the housing 40.

The longitudinal axis C of the barrel 50 preferably forms an angle first angle, V, relative to the plane, P, of the lower surface 43, 49" of the housing 40, which first angle is preferably acute. Preferably, the first angle V is in the interval 50-80°, preferably 60-70°, such as 65°, see e.g. FIG. 7A.

The main body 41 of the housing 40 further comprises a lever arm 60 pivotally connected to the housing 40. The lever arm 60 is configured for providing a motion of a toy top 10 received in the barrel 50 of the housing 40 in a direction of the longitudinal axis of the barre. 50, such that the toy top 10 may be launched/ejected from the launching device 30.

The lever arm 60 is an elongate structure comprising an elongate body 61. The lever arm may further comprise pivot axle part 62 extending transversely to the elongate body 61 of the lever arm 60. The elongate body 61 of the lever arm 60 has a first end 60' and a second end 60" opposite to the first end 60'. The pivot axle part 62 is pivotally connected to the housing 40 of the launching device 30, preferably to the side walls 44 of the main body part 41 of the housing 40. For example, opposite ends of the pivot axle part 62 may be pivotally/rotationally received into holes/openings 48 in the side walls 44 of the housing 40. In other embodiments, and a shown, a through-going, longitudinal hole 66 through the pivot axle part 62 (in the direction perpendicular to the longitudinal direction of the elongate body of the lever arm 60) may be formed to receive a (not shown) pivot axle, which may extend through through-going, longitudinal hole 66 and through openings/holes in the side walls 44 of the housing 40 to provide a rotational connection between the housing 40 and the lever arm 60.

The elongate body 61 of the lever arm 62 comprises a first portion 63 extending towards the first end 60' of the lever arm from the pivot axle part 62 of the lever arm 60. The first portion of the elongate body 61 of the lever arm 60 extends into the barrel 50 formed in the housing 40, such that the first end 60' of the elongate body 61 of the lever arm 62 is approximate to the longitudinal axis C of the barrel 50.

The elongate body 61 of the lever arm 62 further comprises a second portion 64 extending towards the second end 60" of the lever arm 60 from the pivot axle part 62 of the lever arm 60. The second portion 64 of the elongate body 61 of the lever arm 60 extends away from the barrel 50 and preferably towards out of an opening formed through the back surface 46 of the housing 40, such that the second end 60" of the elongate body 61 of the lever arm 62 extends out of the housing, where it may be accessed by a user to rotate/pivot the level arm 60, which will be described in further detail below.

Figure 4:
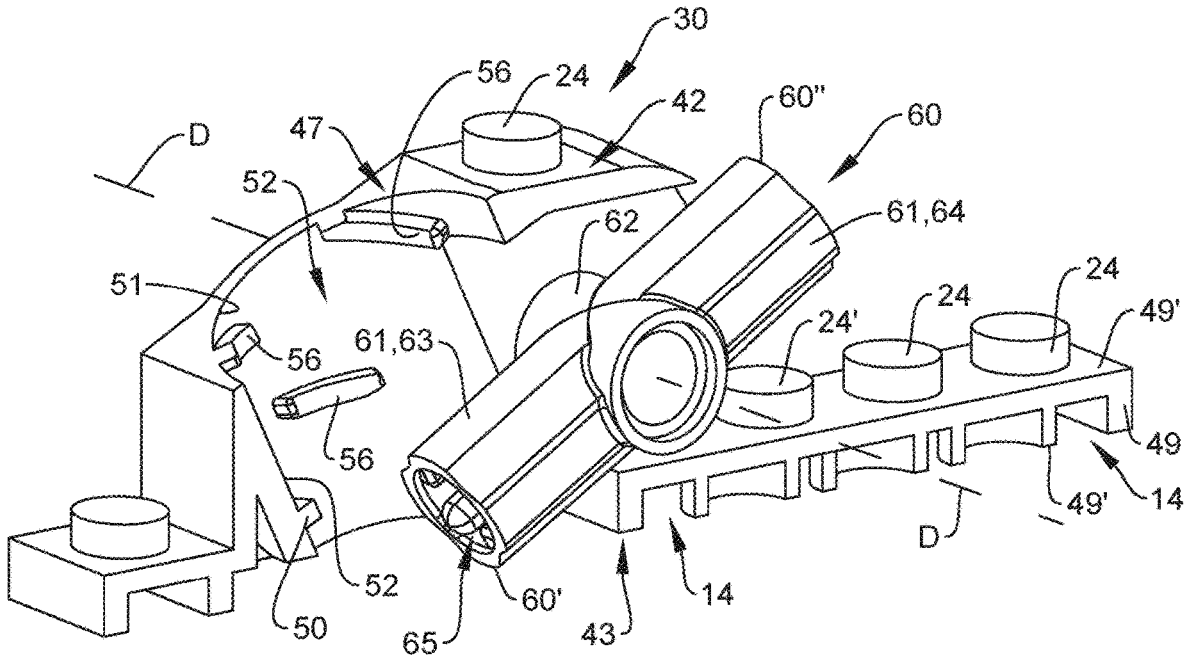
FIG. 4, in a perspective view, shows a partial section, through the toy top launcher shown in FIG. 3.

As shown in e.g. FIGS. 3 and 4, the elongate body 61 of the lever arm 60 may further be provided with a longitudinal hole 65. The longitudinal hole 64 may be through-going. The longitudinal hole 65 is configured for receiving a lever arm extender e.g. an elongate shaft.

Returning now to e.g. FIG. 2, the outer surface 25 of the launch adapter 20 may be provided with a screw thread, in the form of one or more helical grooves 25 formed as elongate winding indentions in the outer surface 25 of the body 21 of the launch adapter 20.

The threading at the outer surface 25 of the launch adapter is, as shown in FIGS. 3, 4 6 and 7, configured to cooperate with a screw thread formed as one or more bead sections or flanges 56 formed radially extending from the cylindrical surface 52 of the barrel 50. The bead sections 56 may be formed along one or more helical paths corresponding to the helical grooves 25 formed in the outer surface 25 of the body 21 of the launch adapter 20.

The screw thread (helical groove 26) on the launch adapter 20 and the screw thread (bead sections 56) in the barrel 50 are configured to cooperate, i.e. by mating handedness, angles of attack, pitch etc.

The bead sections 56 forming the screw thread in the barrel of the FIGS. 4-7 embodiment may be replaced by round knobs or one or more continuous beads extending from the wall 52.

The screw thread (helical groove 26) on the launch adapter 20 (and thereby also the screw thread (bead sections 56) in the barrel 50) in this embodiment preferably has a pitch i.e. an angle of attack of the screw thread of 20.9° relative to a planar upper surface of the launch adapter 20.

Other embodiments of providing a mating set of screw threads are described below in connection with FIGS. 8-11 and 12-15, respectively. However, first we return to FIGS. 5A-B in order to explain how the toy top launcher 30 functions, i.e. how a toy top 10 may be launched from the toy to launcher 30.

Figure 5A:
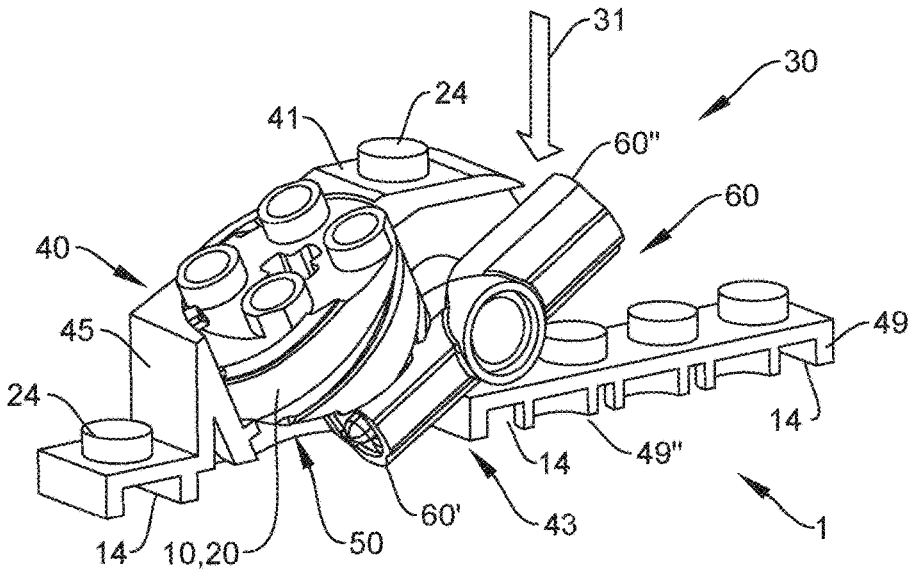
FIG. 5A, in a perspective view, shows a toy system according to an embodiment of the invention, the toy system comprising a toy top launcher and a toy top—represented by a launcher adapter, and illustrating a first stage of launching an toy top.

FIG. 5A shows a toy top launcher 30 as described above. A toy top 10, here simply represented by a launcher adapter 20 has been placed in the barrel 50 of the toy top launcher 30. A user may place the launcher adapter 20 in the barrel 50 by placing it at the opening 51 to the barrel 50 with the second end 21" of the launcher adapter 20 facing towards the barrel 50. The user may then enter the launcher adapter into the barrel by turning the launcher adapter 20 relative to the toy top launcher 30, so that the screw thread (helical grooves 26) in the outer surface of the adapter body 21 interacts with the screw thread (bead sections 56) in the wall 52 of the barrel 50, whereby the launcher adapter 50 is screwed down into the barrel 50. When the launcher adapter 20 is fully inserted into the barrel, the second end 21" of the adapter body 21 of the launcher adapter 20 engages and has pressed the first end 60' of the lever arm downward into the barrel 50 towards the lower end of the barrel. 50. The second end 60" of the lever arm has been turned upward. Thereby, the launcher adapter 20 is ready for being launched, by tilting/rotating the lever arm 60.

When in this position, as shown in FIG. 5A (and in FIGS. 6A and 7B), the launcher adapter 20 may be launched from/ejected from the toy top launcher 30 by pressing or slamming the second end 60" of the lever arm 60 downwards (towards the lower flat surface 43, 49") as indicated by the arrow 31 in FIG. 5A.

The second end 60" of the lever arm 60 may be pressed or slammed downward by the user hitting it, for example with the tip on a finger.

Figure 5B:
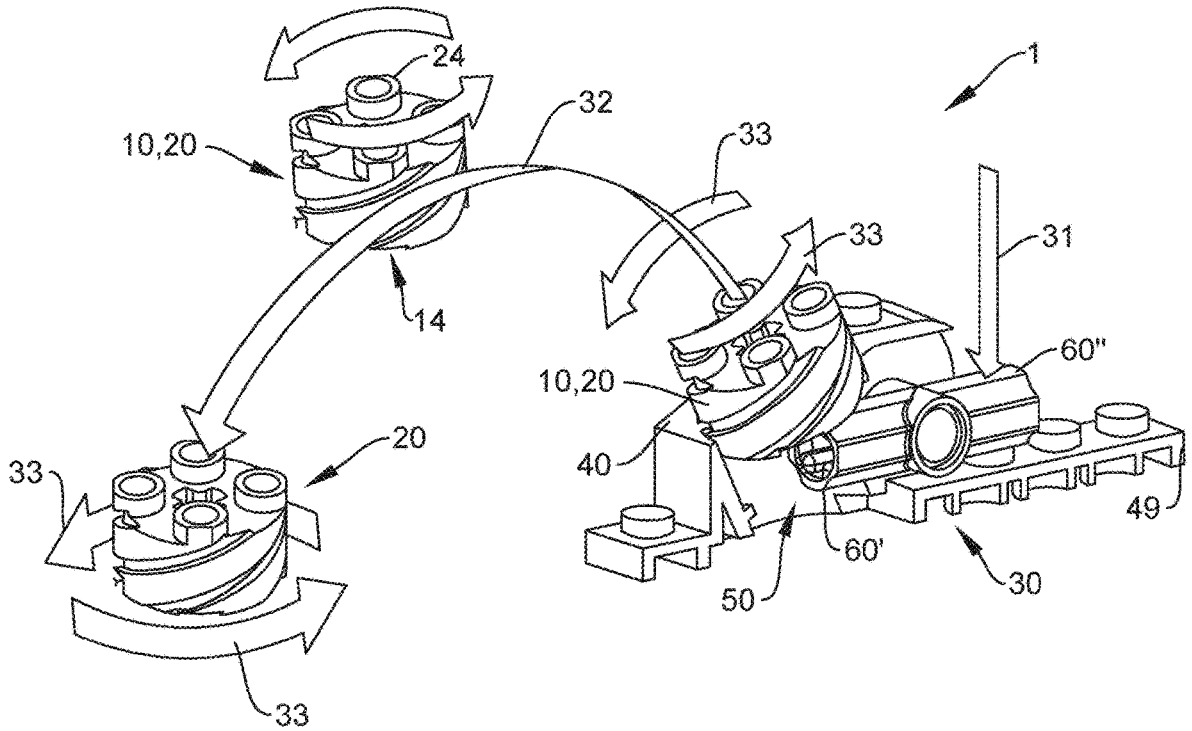
FIG. 5B, in a perspective view, shows the toy system of FIG. 5B, wherein the toy top is illustrated in further stages of the launch and in launched positions.
Figure 6A:
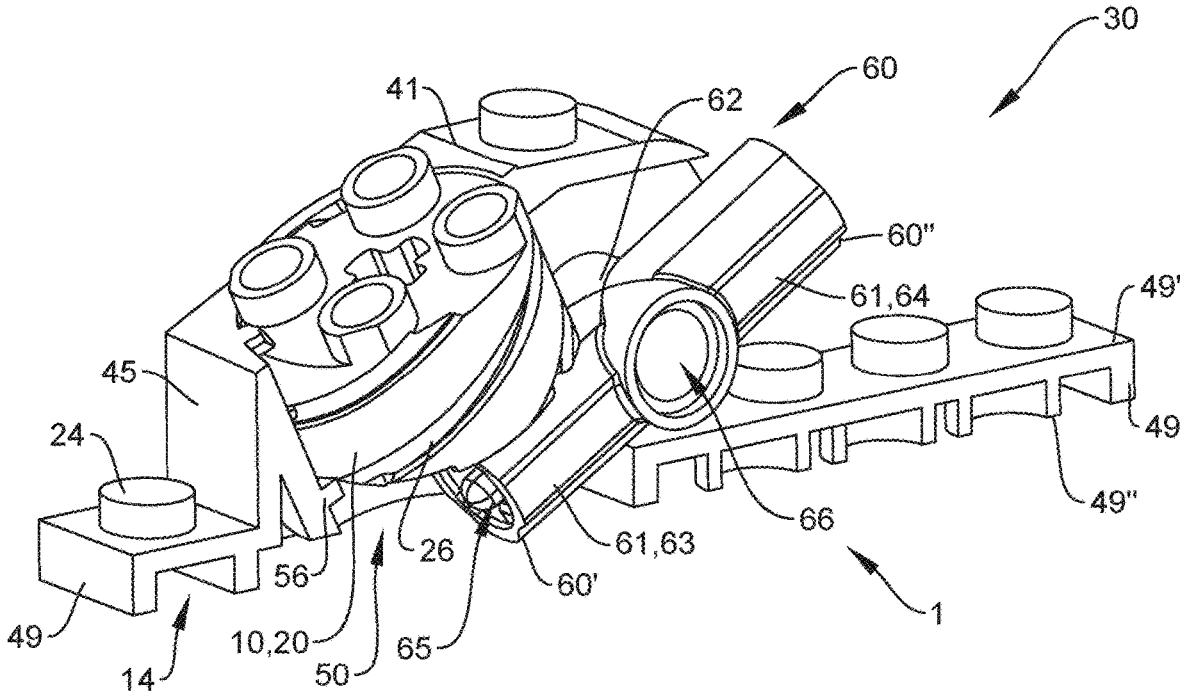
FIG. 6A, in a perspective view, shows a section through the toy top launcher of FIG. 3 with a launcher adapter placed in a barrel of the toy top launcher, and a lever arm of the toy top launcher in a position ready for launching the launcher adapter.
Figure 6B:
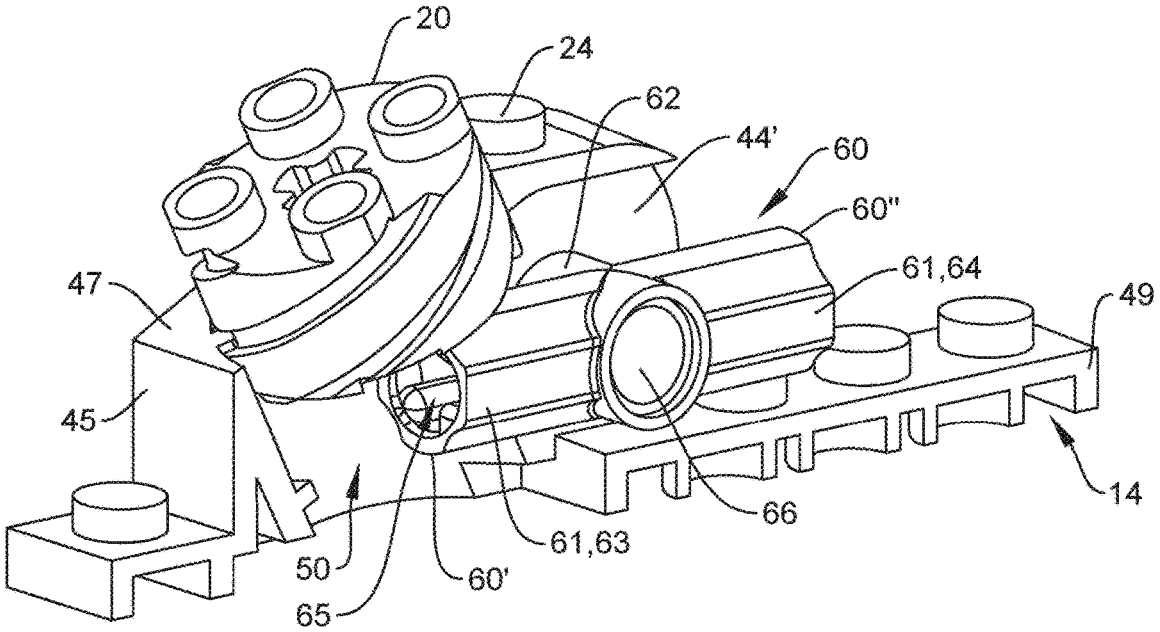
FIG. 6B, in a perspective view, shows the toy top launcher of FIG. 6A, where the lever arm has pushed launcher adapter to a position in the barrel just before the launcher adapter is about to be released from the toy top launcher.

FIG. 5B illustrates what happens when the second end 60" of the lever arm 60 is pressed or slammed downward. The downward motion of the second end 60" of the lever arm causes the elongate body 61 of the lever arm to rotate about the pivot axle part 62 and the pivot axis D of the lever arm, thereby forcing the first end 60' of the lever arm 60, which is in contact with the second, lower end surface 23 of the launcher adapter 20, to move/rotate upwards in the barrel 50, thereby pressing the launcher adapter 20 in an upward direction. Due to the cooperating screw threads 26, 56 on the launcher adapter 50 and in the barrel 50, the launcher adapter 30 is caused to rotate during its upward movement in the barrel 50, as indicated by the arrows 33 in FIG. 5B.

When the lower, second end surface 23 of the launcher adapter 20 is flush with the slanted surface 47 of the housing 40 of the toy top launcher 30, and the screw threads on the launcher adapter 20 and in the barrel 50 are no longer in contact, the launcher adapter will continue upwards and away from the toy top launcher 30, following a trajectory, indicated by arrow 32 in FIG. 5B, the trajectory, being defined by the angle V of the barrel and the force by which the second 60" of the lever arm 60 been pressed down. As indicated by the arrows 34 in FIG. 5B, the rotation of the launcher adapter 20 imparted by the mating screw threads (26, 56) continues during the flight of the launcher adapter 20. In the far left of FIG. 5B, it is illustrated that the launcher adapter 20 has reached a surface, such as the surface of a floor or a table, and the arrows 35, indicates a rotation of the launcher adapter in this position also. If sufficient power has been provided to send the toy top 10 (launcher adapter 20) flying high enough, the toy top/launcher adapter 20 may jump on the surface, where it lands.

Figure 7B:
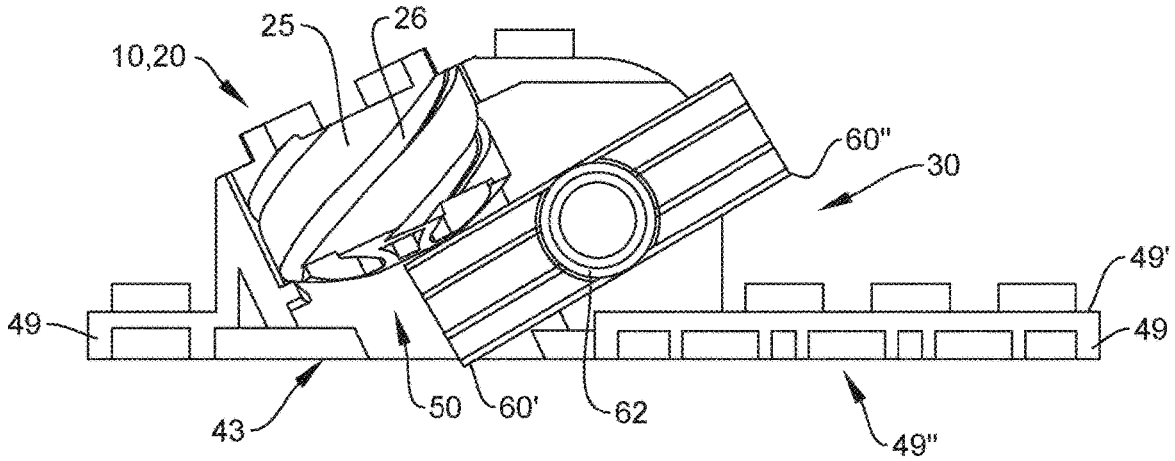
FIG. 7B, in a sectional side view, shows a section through the toy top launcher of FIG. 7A with a launcher adapter placed in a barrel of the toy top launcher, and a lever arm of the toy top launcher in a position ready for launching the launcher adapter.
Figure 7C:
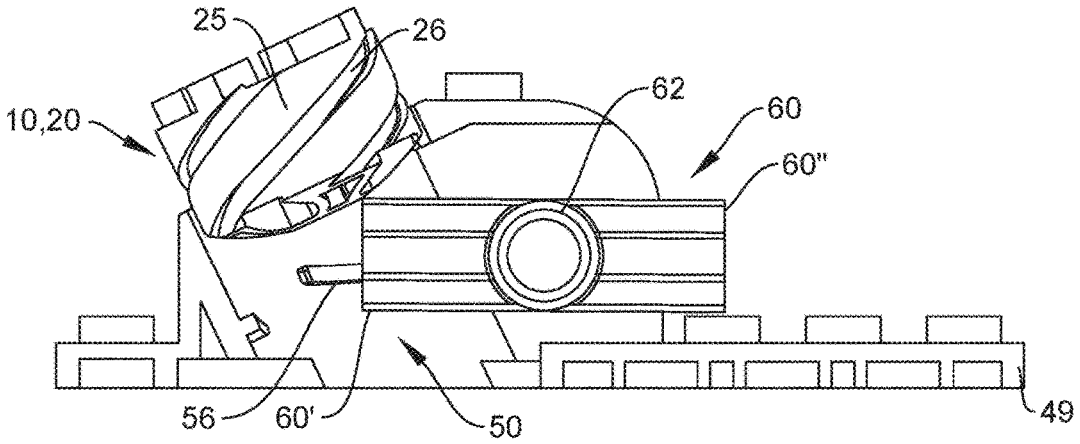
FIG. 7C, in a sectional side view, shows the toy top launcher of FIG. 7B, where the lever arm has pushed launcher adapter to a position in the barrel just before the launcher adapter is about to be released from the toy top launcher.

In order for the rotation to be extended for a longer time, after the launcher adapter 20 has reached the surface, the lower end surface 23 of the launcher adapter 20 is preferably formed with a rounded shape as may be seen in FIGS. 7B and 7C.

It will be appreciated, that a set/group of users, each being provided with a toy top launcher 30 and a toy top 10 comprising at least a launcher adapter 20, will be able to simultaneously or close after each other launch individual toy tops 10/launcher adapters 20, whereby the individual toy tops may bounce and/or rotate among each other thereby emulating a battle between them.

In the above, the function of the toy top 10 and the toy top launcher 30 has been described in connection with FIGS. 5A and 5B. FIGS. 5A and B shows the embodiment of the launcher adapter 20 of FIG. 2 and FIGS. 3-4, and 6-7, and the toy top launcher 30 of FIGS. 3-4, and 6-7. FIGS. 8-11 show another embodiment of a launcher adapter 20 and a corresponding toy top launcher 30. FIGS. 12-15, show yet an embodiment of a launcher adapter 20, and a corresponding toy top launcher 30. It will be appreciated that the shown embodiments works in basically the same way. In the following the embodiments of FIGS. 8-1 and 12-15 will be described with an emphasis of the differences to the FIG. 2-7 embodiments.

Figure 8:
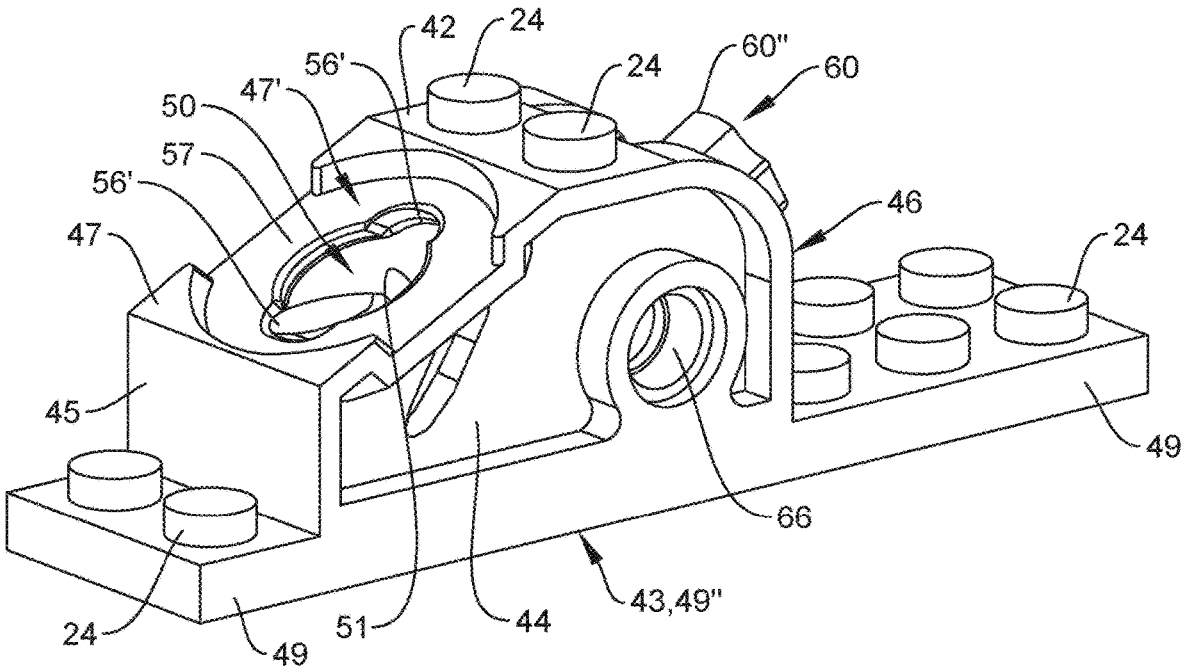
FIG. 8, in a perspective view; shows a toy top launcher according to another embodiment than in the previous figures, and for cooperating with a launcher adapter configured differently, than the launcher adapter shown in the previous figures.
Figure 9:
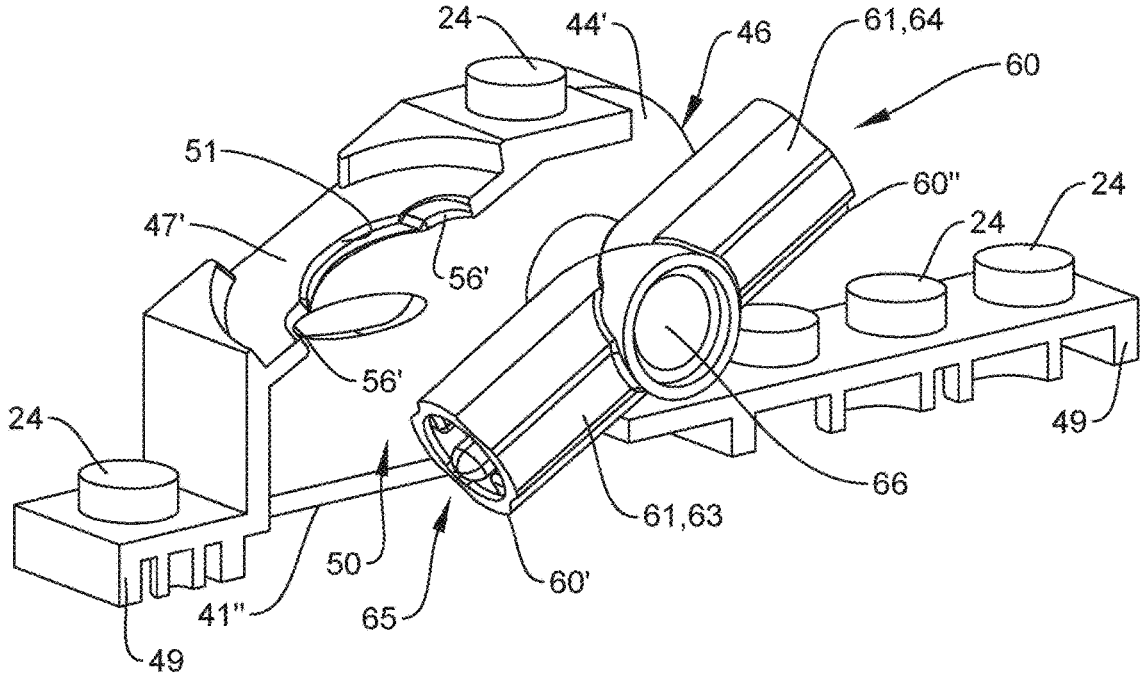
FIG. 9, in a perspective view, shows a partial section, through the toy top launcher shown in FIG. 8.
Figure 10A:
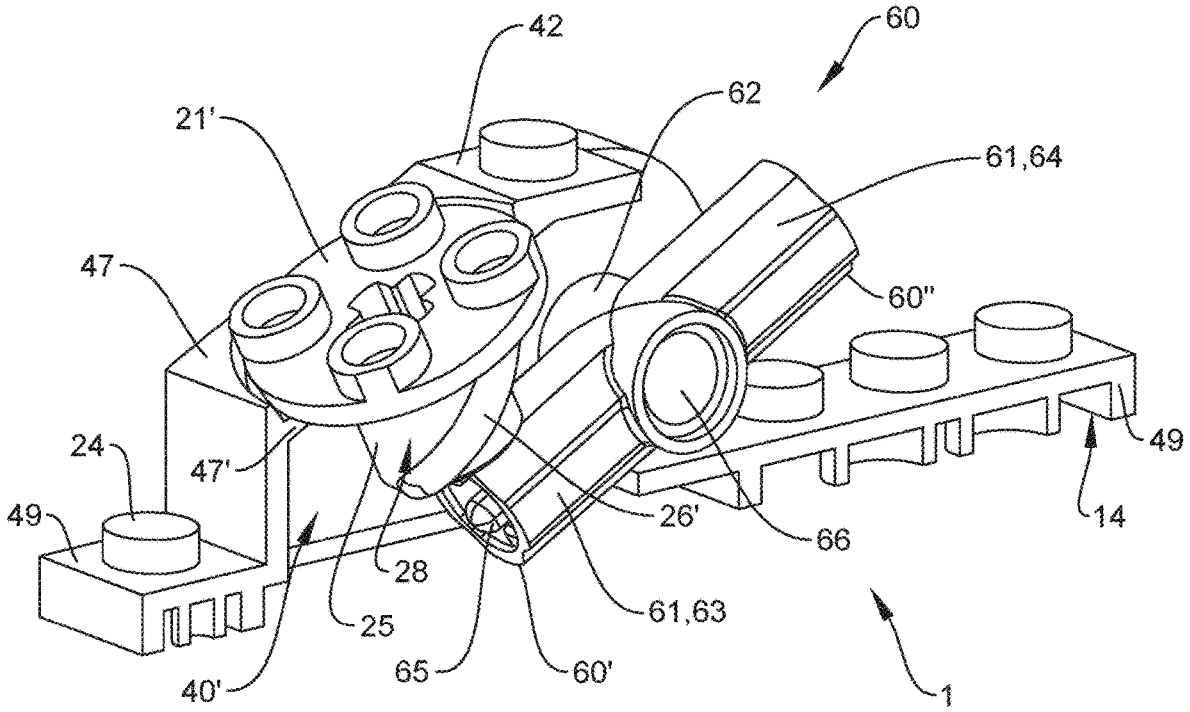
FIG. 10A, in a perspective view, shows a section through the toy top launcher of FIG. 8 with a launcher adapter placed in a barrel of the toy top launcher, and a lever arm of the toy top launcher in a position ready for launching the launcher adapter.
Figure 10B:
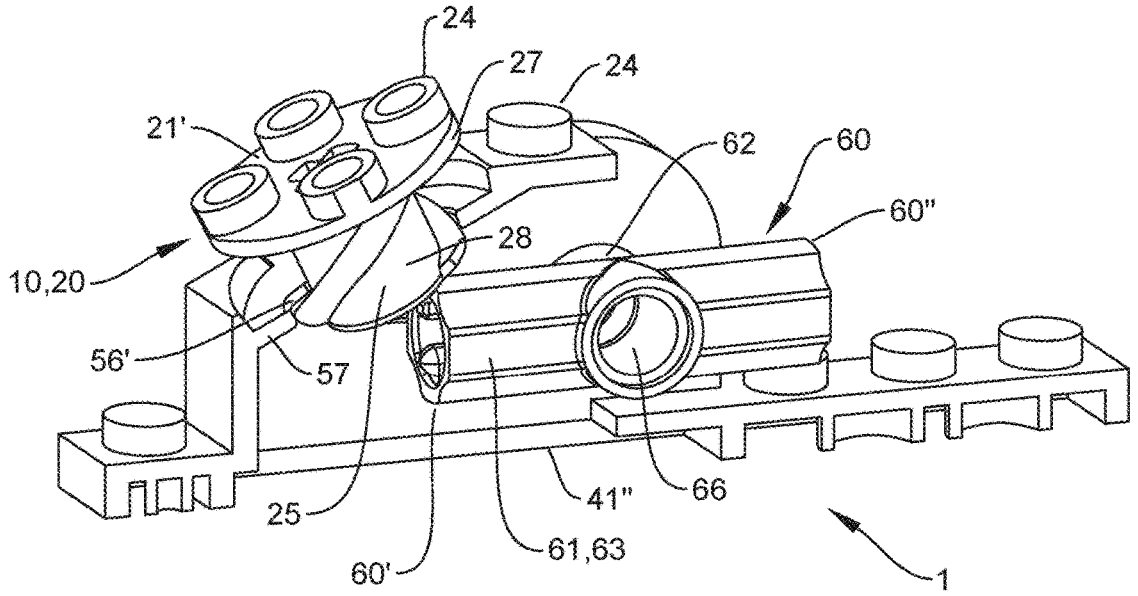
FIG. 10B, in a perspective view, shows the toy top launcher of FIG. 10A, where the lever arm has pushed launcher adapter to a position in the barrel just before the launcher adapter is about to be released from the toy top launcher.
Figure 11A:
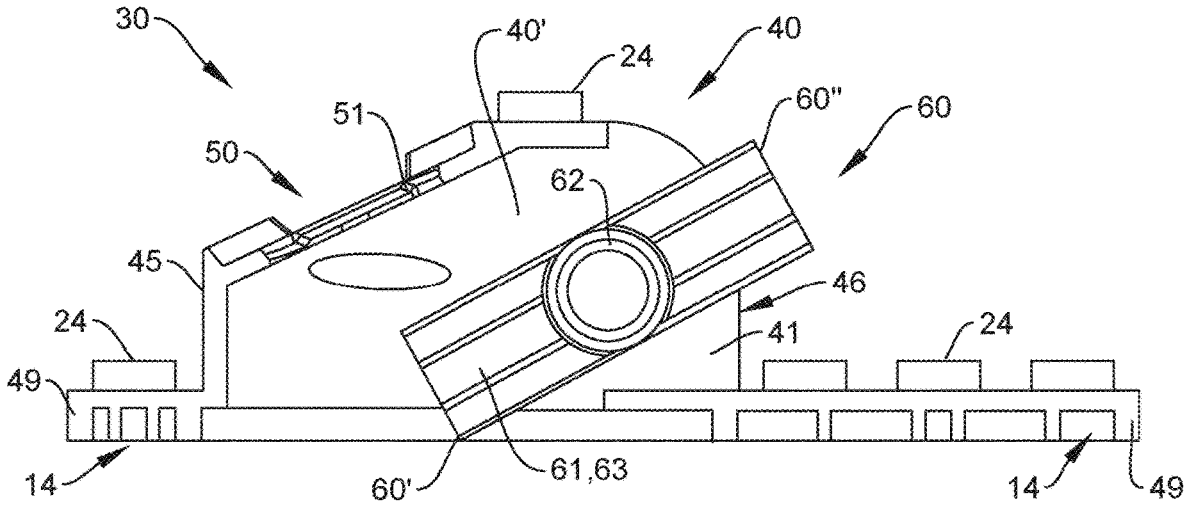
FIG. 11A, in a sectional side view, shows the toy top launcher shown in FIG. 8.
Figure 11B:
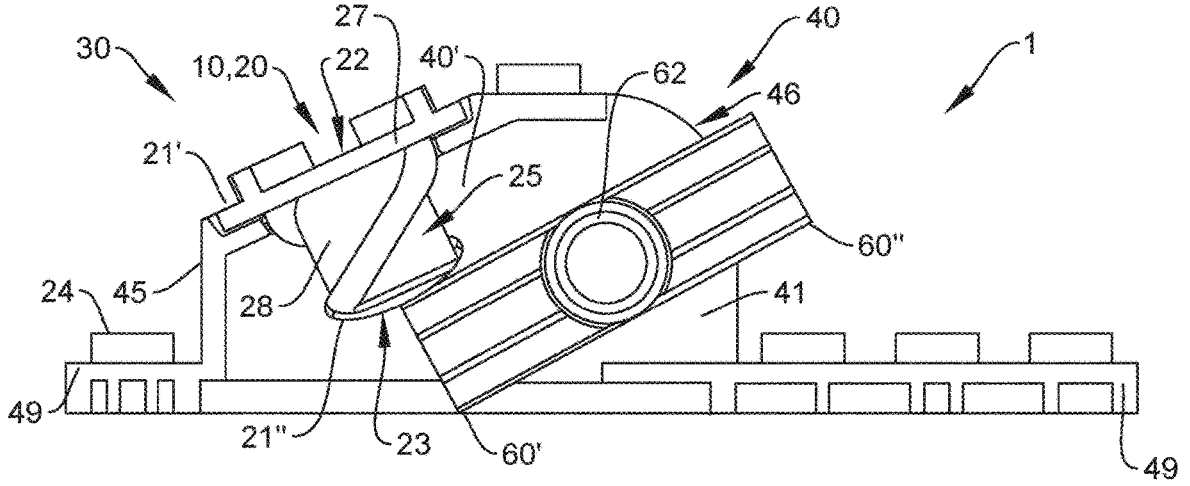
FIG. 11B, in a sectional side view, shows a section through the toy top launcher of FIG. 11A with a launcher adapter placed in a barrel of the toy top launcher, and a lever arm of the toy top launcher in a position ready for launching the launcher adapter.
Figure 11C:
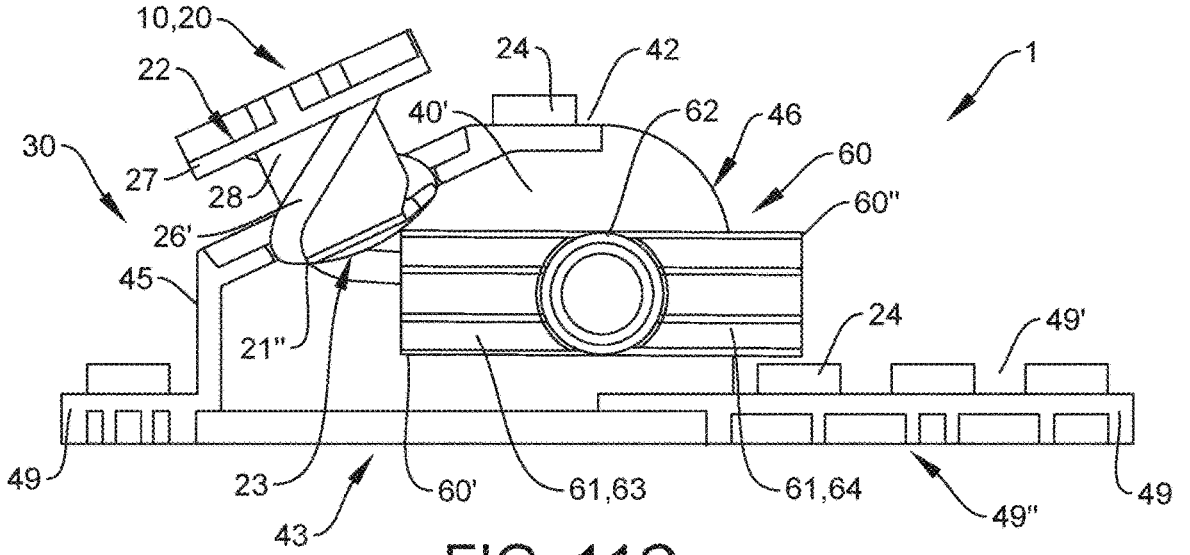
FIG. 11C, in a sectional side view, shows the toy top launcher of FIG. 11B, where the lever arm has pushed launcher adapter to a position in the barrel just before the launcher adapter is about to be released from the toy top launcher.

Turning first to FIGS. 8 and 9, these figures shows a toy top launcher 30 for cooperating with a different type of launcher adapter 20, than described above. The alternative launcher adapter 20 is e.g. shown in FIGS. 10A-B and FIGS. 11B-C.

In order to cooperate with the alternatively shaped launcher adapter 20, the toy top launcher 30 in FIG. 8-11 has been altered relative to the toy top launcher 30 described above in a few ways. Basically, the housing 40 is provided in same way as previously described.

However, the slanted surface 47 is provided with a cylindrical depression 47' configured for receiving a top flange 27 of the adapter body 21. The opening 51 to the barrel 50 is formed through a launch flange 57 forming the bottom of the cylindrical depression. The opening 51 to the barrel 50 further has been reduced in diameter (relative to the above embodiments, and relative to a diameter of the top flange 27 of the adapter body 21) to receive a tail body 28 of the adapter body 21, the tail body 28 having a smaller diameter than the top flange 27 of the adapter body 21.

Also, the side wall 52 of the barrel 50 is basically reduced to a rim at the opening 51.

In this embodiment, the screw thread of barrel 50 is provided by two indentions 56' or notches formed diametrically opposite to each other on the opening 51 in the a launch flange 57. The screw thread in the form of the two indentations 56'/notches are preferably shaped and dimensioned to receive two helical beads 26' formed on the side surface 25 of the adapter body 21, more specifically in the outer surface 25 of the tail body 28 of the adapter body 21.

The screw thread (helical bead 26') on the launch adapter 20 and the screw thread (indentations 56') in the barrel 50 are configured to cooperate, i.e. by mating handedness, angles of attack, pitch etc.

The screw thread (helical bead 26') on the launch adapter 20 (and thereby also the screw thread (indentations 56') in the barrel 50) in this embodiment preferably has a pitch, i.e. an angle of attack of the screw thread of 32.5° relative to a planar upper surface of the launch adapter 20.

Figure 12:
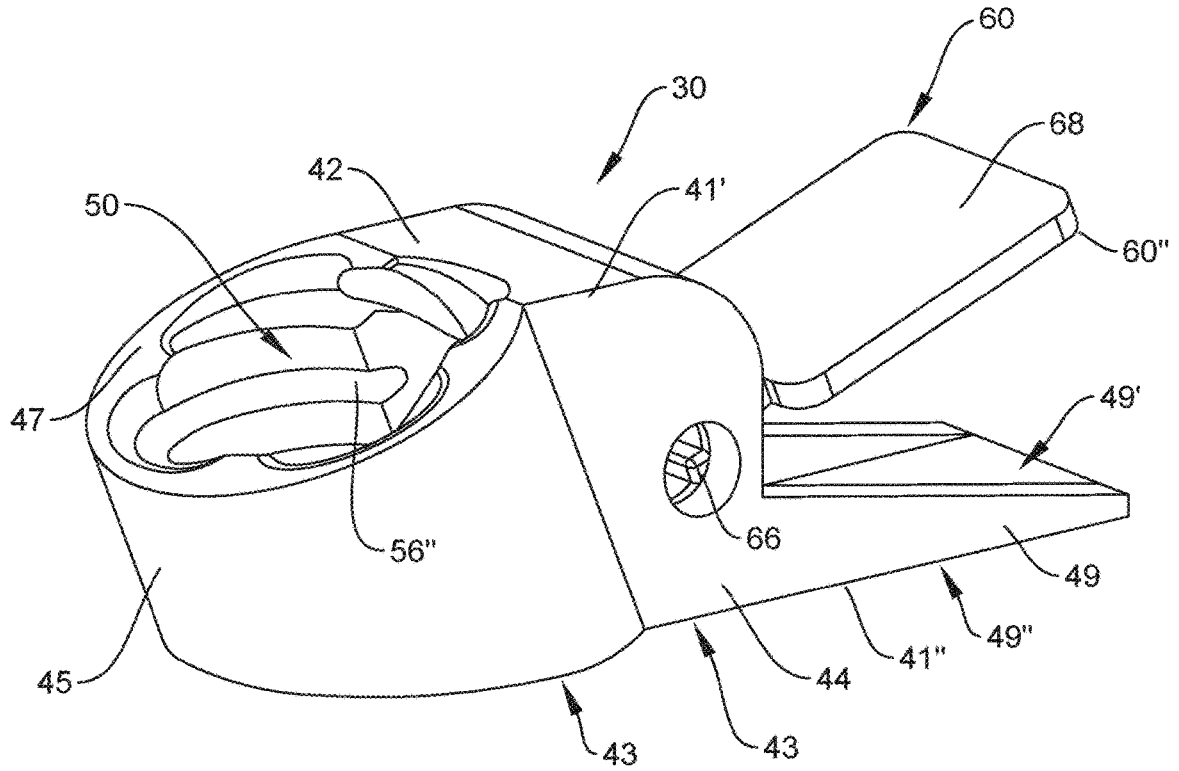
FIG. 12, in a perspective view; shows a toy top launcher according to another embodiment than in the previous figures, and for cooperating with a launcher adapter configured differently, than the launcher adapter shown in the previous figures.
Figure 13:
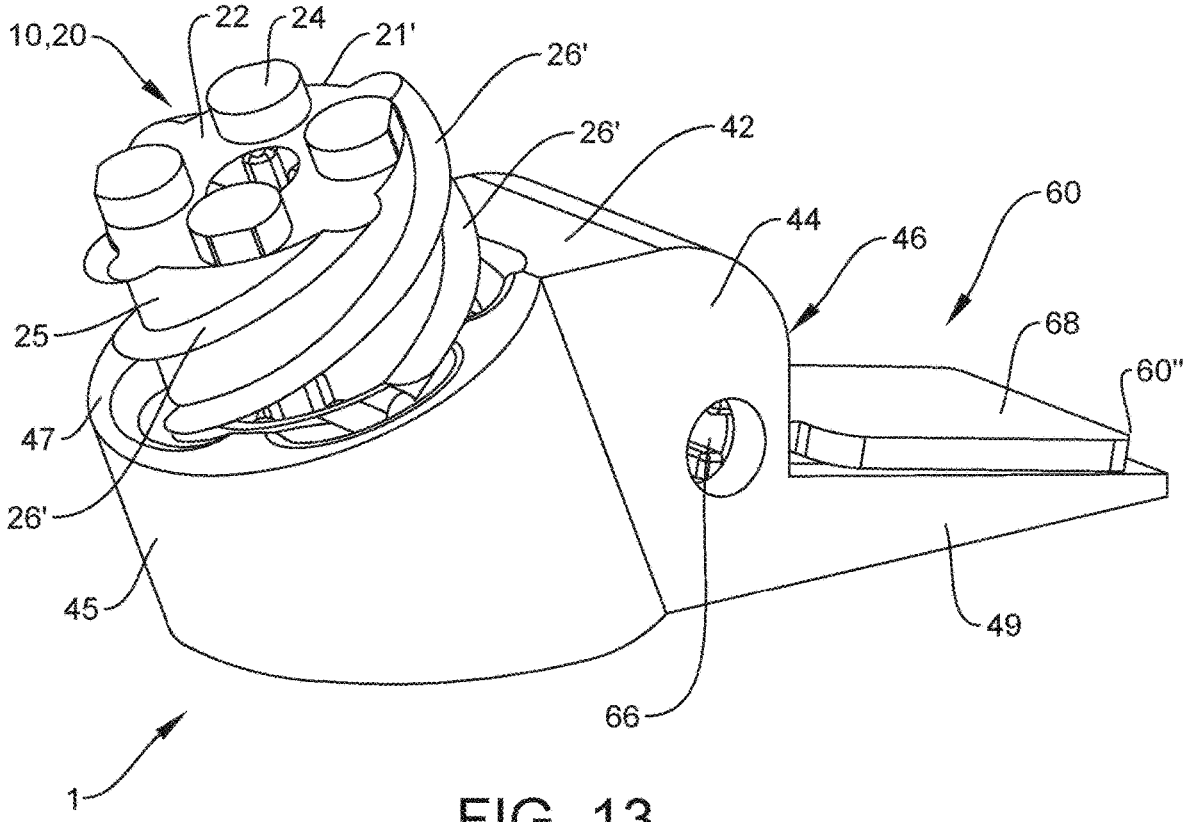
FIG. 13, in a perspective view; shows the toy top launcher of FIG. 12 with a launcher adapter configured differently, than the launcher adapter shown in the FIGS. 1-11.
Figure 14A:
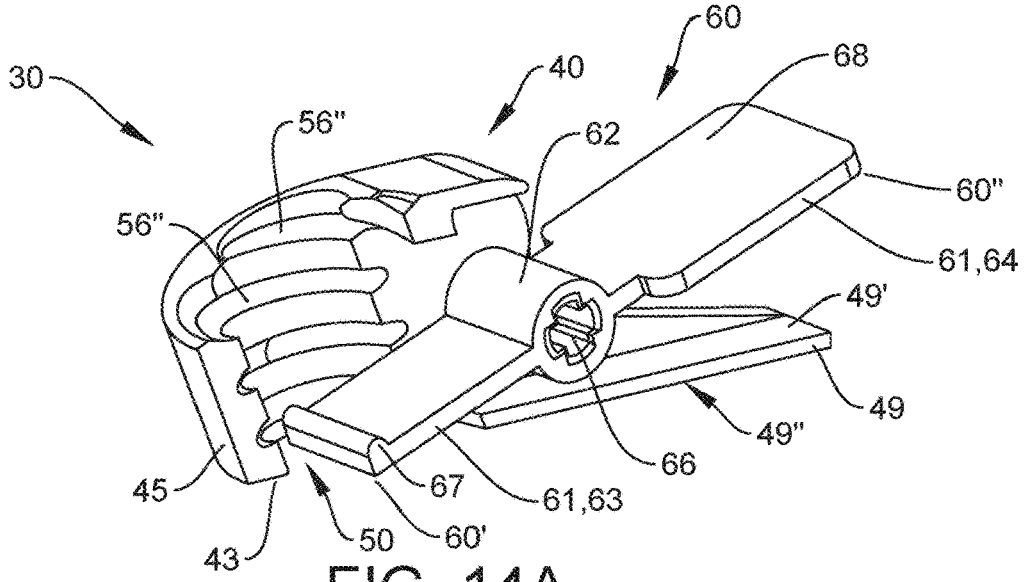
FIG. 14A, in a perspective view, shows a partial section, through the toy top launcher shown in FIG. 12.
Figure 14B:
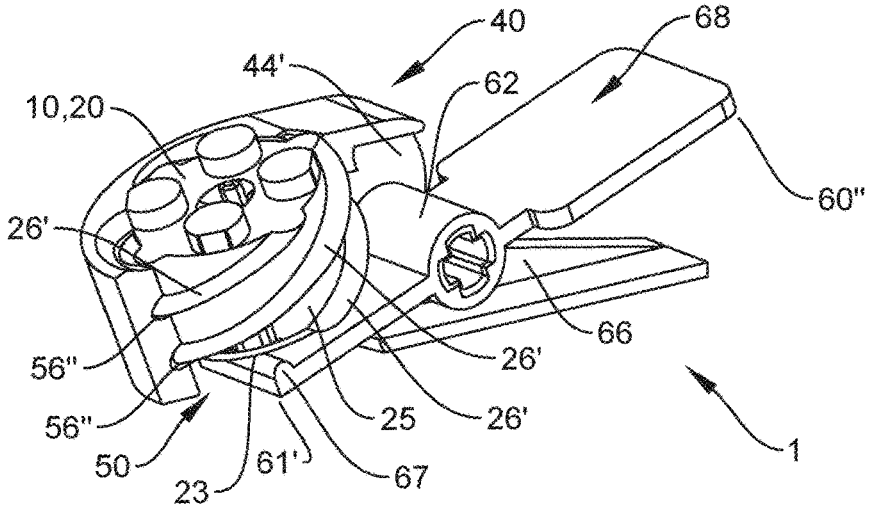
FIG. 14B, in a perspective view, shows a section through the toy top launcher of FIG. 12 with a launcher adapter as shown in FIG. 13 placed in a barrel of the toy top launcher, and a lever arm of the toy top launcher in a position ready for launching the launcher adapter.
Figure 14C:
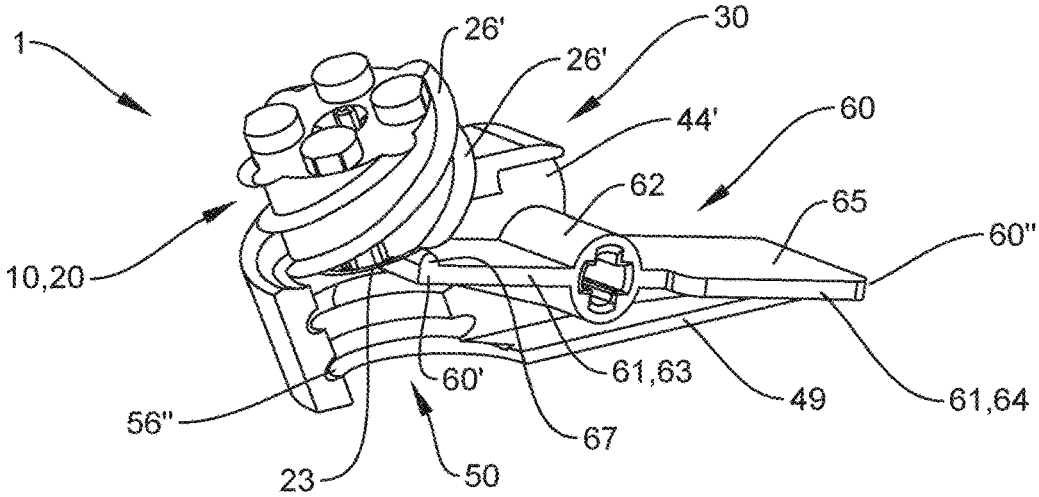
FIG. 14C, in a perspective view, shows the toy top launcher of FIG. 14B, where the lever arm has pushed launcher adapter to a position in the barrel just before the launcher adapter is about to be released from the toy top launcher.
Figure 15A:
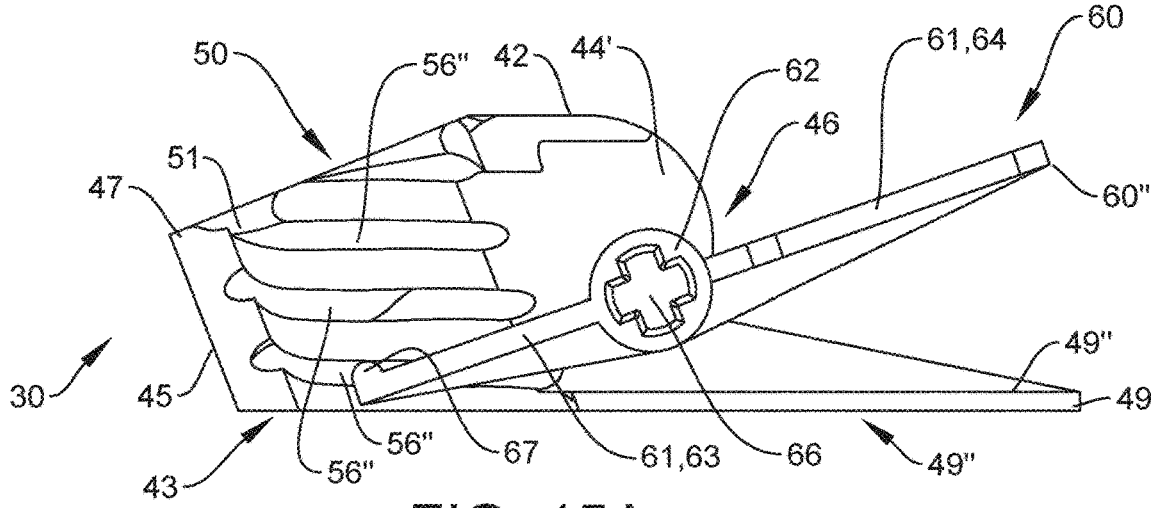
FIG. 15A, in a sectional side view, shows the toy top launcher shown in FIG. 12.
Figure 15B:
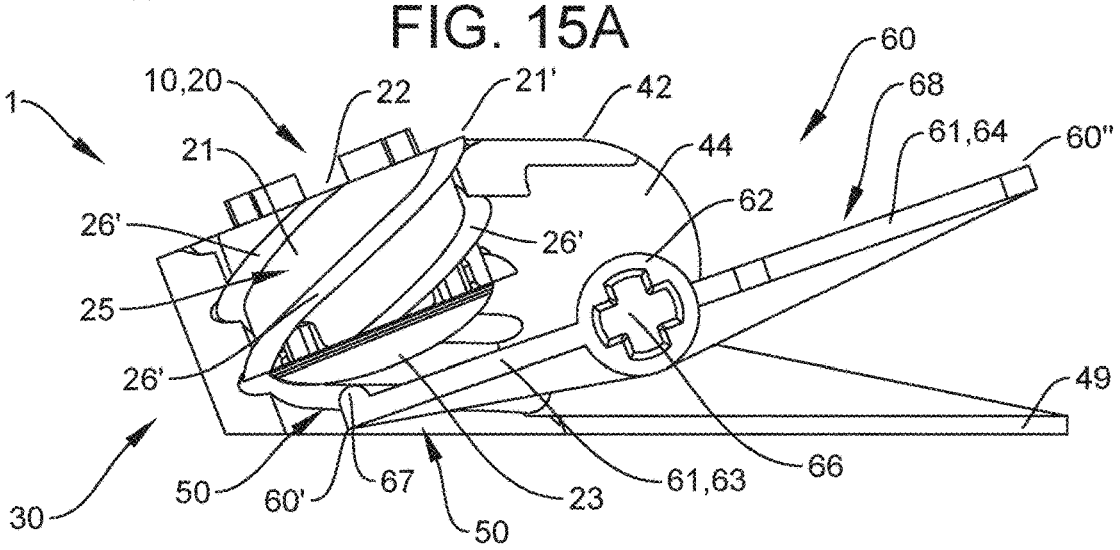
FIG. 15B, in a sectional side view, shows a section through the toy top launcher of FIG. 15A with a launcher adapter placed in a barrel of the toy top launcher, and a lever arm of the toy top launcher in a position ready for launching the launcher adapter.
Figure 15C:
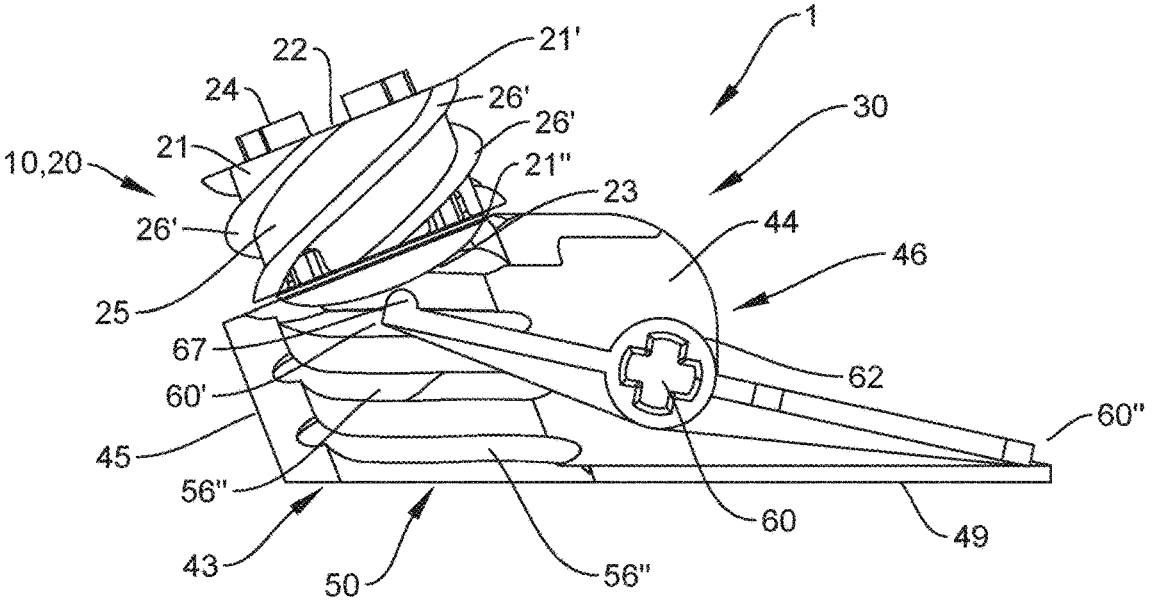
FIG. 15C, in a sectional side view, shows the toy top launcher of FIG. 15B, where the lever arm has pushed launcher adapter to a position in the barrel just before the launcher adapter is about to be released from the toy top launcher.

Turning now to FIGS. 12 and 13, these figures shows a toy top launcher 30 for cooperating with a different type of launcher adapter 20, than described above. The alternative launcher adapter 20 is e.g. shown in FIGS. 14B-C and FIGS. 15B-C.

In order to cooperate with the alternatively shaped launcher adapter 20, the toy top launcher 30 in FIG. 12-15 has been altered relative to the toy top launcher 30 described above in a few ways. Basically, the housing 40 is provided in same way as previously described. However instead of having perpendicularly arranged walls the main body part 41 of the housing 40 here forms a slanted cylindrical shape. Also, the lower flat plate is formed differently. In the shown embodiment (FIGS. 12-15) no attachment means of the first type 24 or the second type 14 are provide on any surfaces. It will however be appreciated that such attachment means may in not shown further embodiments be provided with attachment means of the first type 24 and/or attachment means of the second type 14, for example by providing them in similar positions as in e.g. the FIG. 3-7 embodiments.

The different embodiment of the launcher adapter 20 is visible in FIGS. 14B-C and FIGS. 15B-C. The launcher adapter 20 is formed basically as described in connection with FIGS. 1-2 and FIGS. 3-7 above. However, instead of having a screw thread arranged as one or more helical grooves 26 formed as elongate winding depressions in the outer surface 25 of the adapter body 21, in the present embodiment, the screw thread is provided as one or more helical beads 26' extending radially outward from the outer surface 25 of the adapter body 21. The one or more helical beads 26' on the outer surface 25 of the adapter body 21 is configured for cooperating with a corresponding number of elongate helical indentations 56" formed in inner wall 52 of the barrel 50.

The screw thread (helical bead 26') on the launch adapter 20 and the screw thread (elongate helical indentations 56") in the barrel 50 are configured to cooperate, i.e. by mating handedness, angles of attack, pitch etc.

The screw thread (helical bead 26') on the launch adapter 20 (and thereby also the screw thread (elongate helical indentations 56") in the barrel 50) in this embodiment preferably has a pitch, i.e. an angle of attack of the screw thread of 20.9° relative to a planar upper surface of the launch adapter 20.

The embodiment of the toy top launcher 30 in FIGS. 12-15 also differs from that of FIGS. 3-7 in that the lever arm 60 has been differently formed. In this case, the lever arm 60 is formed as a flat elongate body 61. The second portion 64 of the elongate body 61 in this case is formed with an enlarged flattened portion 68.

The lever arm 60 embodiment of the toy top launcher 30 in FIGS. 12-15 also differs from that of FIGS. 3-7 in that it has an elongate bead 67 formed at an upwardly facing surface of the lever arm 60 at the first end 60' thereof. The elongate bead is adapted to cooperate with a rounded lower end/second end surface 23 of the launcher adapter 20.

Figures 16, 17:
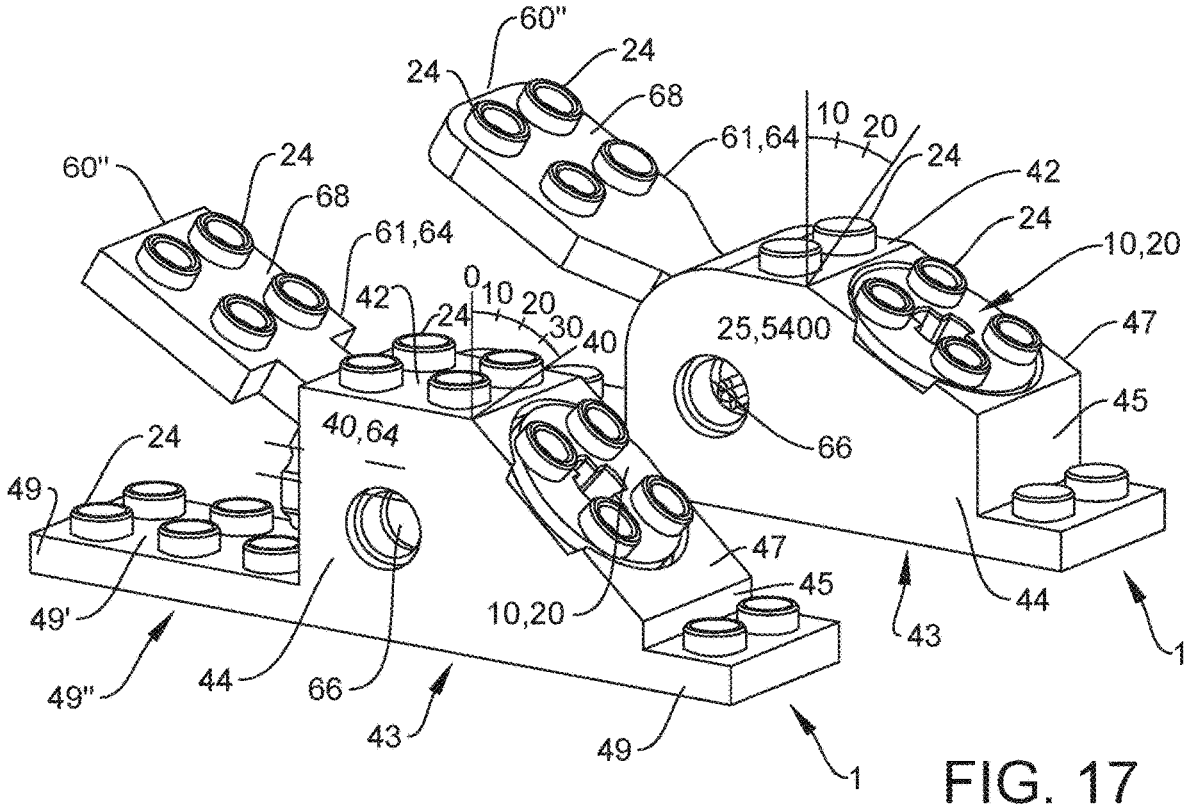
FIG. 16, in a perspective view, shows another embodiment of a toy top launcher and a launcher adapter placed therein.
FIG. 17, in a perspective view, shows yet another embodiment of a toy top launcher and a launcher adapter placed therein.

FIGS. 16 and 17 shows to further embodiments of the launcher 30, and with a launcher adapter arranged in a barrel 50 of the launcher 30. FIGS. 16 and 17 illustrate two different launch angles V. The launcher 30 of FIG. 16 has low front wall 45, whereby the slanted surface 47 of the main body part of the housing of the toy top launcher 30 becomes steeper than in FIG. 17, where the launcher 30 has a higher front wall 45.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific injection moulding procedure have not been described in detail since it is maintained that the person skilled in the art would be able to find suitable materials and suitable processes to manufacture the container according to the current invention.

LIST OF PARTS

1 toy system
10 toy top
11 main body portion of toy top
11' first end of main body portion of toy top
11" second end of main body portion of toy top
12 first end surface at first end of main body portion of toy top
12' rim at first end of main body portion of toy top
14 attachment means of the second type
20 launcher adapter
21 adapter body
21' first end of adapter body
21" second end of adapter body
22 first end surface at the first end of the adapter body
23 second end surface at the second end of the adapter body
24 attachment means of a first type
25 side surface 25 of the adapter body
26 helical groove(s) formed in the side surface of the adapter body
26' helical bead formed in the side surface of the adapter body
27 top flange of adapter body
28 tail body of adapter body
30 toy top launcher
40 housing of toy top launcher
41 main body part of the housing of the toy top launcher
41' upper rim of main body part of the housing of the toy top launcher
41" lower rim of main body part of the housing of the toy top launcher
42 upper surface formed at the upper end of the main body part of the housing of the toy top launcher
43 flat lower surface formed at the lower end of the main body part of the housing of the toy top launcher
44 side walls of the main body part of the housing of the toy top launcher
44' inner surface of side walls of the main body part of the housing of the toy top launcher
45 front wall of main body part of the housing of the toy top launcher
46 back surface of main body part of the housing of the toy top launcher
47 slanted surface of the main body part of the housing of the toy top launcher
47' cylindrical depression in slanted surface
49 plate of toy top launcher
49' upper surface of plate of toy top launcher
49" flat lover surface of plate of toy top launcher
50 barrel/launch port
51 opening in slanted surface of the main body part of the housing of the toy top launcher
52 inner wall of barrel/launch port
56 rotation means/screw thread—taps/bead sections on inner wall of barrel/launch port
56' rotation means/screw thread—indentions in a launch flange
56" rotation means/screw thread—indentations in inner wall of barrel
57 launch flange
60 lever arm
60' first end of lever arm
60" second end of lever arm
61 elongate body of lever arm
62 pivot axle part of lever arm
63 first portion of elongate body of lever arm extending towards the first end of the lever arm from the pivot axle part of the lever arm
64 second portion of elongate body of lever arm extending towards the second end of the lever arm from the pivot axle part of the lever arm
65 longitudinal hole through elongate body of lever arm
66 longitudinal hole through the pivot axle part of the lever arm
67 elongate bead formed at an upwardly facings surface of the lever arm at the first end thereof
68 flattened portion the second portion of elongate body of lever arm
A longitudinal axis of launcher adapter of toy top
B longitudinal axis of main body part of toy top
C longitudinal axis of barrel/launch port
D pivot axis of lever arm
P plane defined by lower surface of the mains body part of the housing
V angle between the plane defined by lower surface of the mains body part of the housing and the longitudinal axis of barrel/launch port

The invention claimed is:

1. A toy system comprising a toy top and a toy top launcher, wherein the toy top comprises a launcher adapter, the toy top launcher including:

a housing;

a barrel formed in the housing and configured for receiving the launcher adapter; and a lever arm pivotally connected to the housing, wherein:

the lever arm has a first end and a second end opposite to the first end, the first end of the lever arm extending into the barrel, the second end of the lever arm extending out of the housing such that upon actuation of the second end of the lever arm, the first end of the lever arm is configured to eject the launcher adapter tram the barrel of the toy top launcher, and the barrel comprises a first screw thread, and the launcher adapter comprises a second screw thread which is configured for cooperating with the first screw thread in the barrel.

2. The toy system according to claim 1, wherein the housing of the toy top launcher has a flat lower surface defining a plane, and wherein the barrel has a longitudinal axis, which forms an acute first angle with said plane.

3. The toy system according to claim 2, wherein said first angle is 50-80°.

4. The toy system according to claim 1, wherein the first screw thread is formed as one or more elongate helical beads radially extending from a wall of the barrel, and wherein the second screw thread is formed as a matching number of helical grooves formed in an outer surface of the launcher adapter.

5. The toy system according to claim 1, wherein the first screw thread is formed as one or more notches in a launch flange surrounding an opening of said barrel, and wherein the second screw thread is formed as a matching number of helical elongate beads formed on and extending from an outer surface of the launcher adapter.

6. The toy system according to claim 1, wherein:

the launcher adapter comprises an adapter body having a first end surface, a second end surface, and a cylindrical outer surface, the second screw thread is arranged at the cylindrical outer surface, and the first end surface is provided with attachment knobs or indentations.

7. The toy system according to claim 6, wherein the second end surface of the launcher adapter has a rounded shape.

8. A method of launcher a toy top, the method comprising:

providing a barrel having a first screw thread;

providing a lever arm having a first end and a second end, wherein the lever arm is pivotal relative to barrel and the first end of the lever arm extends into the barrel;

providing a toy top comprising a launcher adapter provided with a second screw thread being configured for mating with the first screw thread of the barrel;

placing the launcher adapter in the barrel, such that a lower, second end surface of the launcher adapter is in contact with the first end of the lever arm; and providing a push to the second end of the lever arm inducing a rotation of the lever arm, forcing the launcher adapter to move along a longitudinal axis of the barrel and eject from the barrel of the toy top launcher, whereby the mating screw threads on the launcher adapter and the barrel induces a rotation of the launcher adapter.

9. The toy system according to claim 2, wherein said first angle is 65°.

10. A toy system comprising:

a launcher adapter extending from a first to second end, the launcher adapter defining a side surface disposed between the first and second ends, the side surface defining helical grooves;

a toy top launcher including:

a launcher housing having a base;

a barrel port formed in the launcher housing, the barrel port defining helical beads such that the launcher adapter is configured to screw into the barrel port via cooperation of the respective grooves of the launcher adapter and the helical beads of the barrel port; and a lever arm pivotally connectable to the launcher housing, wherein the lever arm, upon pivotal movement, is configured to contact and eject the launcher adapter from the toy top launcher.

11. The toy system according to claim 10, wherein the launcher adapter defines a rotationally symmetrical shape along an axis extending from the first to second end.

12. The toy system according to claim 10, wherein the launcher adapter defines connection cylindrical protrusions on a surface of the first or second end, and indentations cooperating in size with the connection cylindrical protrusions on the other of the first or second end.

13. The toy system according to claim 10, wherein the toy top launcher defines either connective cylindrical protrusions or indentations to frictionally connect with toy building blocks that have the other of the connection cylindrical protrusions or indentations.

14. The toy system according to claim 10, wherein the barrel is aligned in an angled plane relative to a plane of the launcher housing base.

* * * * *